US008359676B2

(12) United States Patent
Richard et al.

(10) Patent No.: US 8,359,676 B2
(45) Date of Patent: Jan. 29, 2013

(54) RELATIVELY COMPACT NON-CONTACT SPRAY TOILET BOWL CLEANING DEVICE

(75) Inventors: Jesse Richard, Racine, WI (US); David A. Smith, Brookfield, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 376 days.

(21) Appl. No.: 12/581,764

(22) Filed: Oct. 19, 2009

(65) Prior Publication Data

US 2011/0088154 A1 Apr. 21, 2011

(51) Int. Cl.
*E03D 9/02* (2006.01)

(52) U.S. Cl. ..... 4/223

(58) Field of Classification Search ..... 4/420.4, 4/420, 222–223, 231
See application file for complete search history.

(56) References Cited

U.S. PATENT DOCUMENTS

| | | | | |
|---|---|---|---|---|
| 1,507,935 | A * | 9/1924 | Sanderson | 206/261 |
| 3,178,070 | A | 4/1965 | Leland | |
| 3,316,559 | A * | 5/1967 | Ewing et al. | 4/223 |
| 3,336,603 | A * | 8/1967 | Leland | 4/223 |
| 4,183,105 | A * | 1/1980 | Womack | 4/300 |
| 4,777,670 | A | 10/1988 | Klinkhammer | |
| 4,873,729 | A | 10/1989 | Micallef | |
| 5,022,098 | A | 6/1991 | Brower | |
| 5,457,822 | A | 10/1995 | Klammsteiner | |
| 5,692,250 | A | 12/1997 | Oldfelt et al. | |
| 5,727,262 | A * | 3/1998 | Littlejohn | 4/213 |
| 5,862,532 | A | 1/1999 | Cain | |
| 6,000,067 | A | 12/1999 | Cascia | |
| 6,029,286 | A * | 2/2000 | Funk | 4/223 |
| 6,178,563 | B1 | 1/2001 | Helfet | |
| 6,178,564 | B1 | 1/2001 | Leonard et al. | |
| 6,230,334 | B1 | 5/2001 | Camp et al. | |
| 6,463,598 | B1 * | 10/2002 | David et al. | 4/591 |
| 6,519,783 | B2 * | 2/2003 | Falchieri | 4/231 |
| 6,622,315 | B1 * | 9/2003 | Feygin et al. | 4/223 |
| 6,772,450 | B1 | 8/2004 | Saylor et al. | |
| 6,817,040 | B2 | 11/2004 | Klinkhammer et al. | |
| 7,263,727 | B1 * | 9/2007 | Zhurin et al. | 4/300 |
| 7,316,038 | B2 | 1/2008 | Egeresi | |
| 7,322,052 | B2 | 1/2008 | Alexander | |
| 8,048,010 | B2 * | 11/2011 | Ohashi et al. | 601/155 |
| 2007/0136937 | A1 | 6/2007 | Sawalski et al. | |
| 2007/0234470 | A1 | 10/2007 | Sawalski et al. | |

(Continued)

FOREIGN PATENT DOCUMENTS

| | | |
|---|---|---|
| EP | 1507935 B1 | 7/2006 |
| WO | WO 99/66139 | 12/1999 |

(Continued)

OTHER PUBLICATIONS

PCT/US2010/002785 International Search Report dated Feb. 18, 2011.

*Primary Examiner* — Lori Baker

(57) ABSTRACT

A device for providing cleansing composition to the inner surface of a wall of an enclosure with a fluid, the device having: (a) a first fluid spray bar having an interior space for receiving fluid from a source of the fluid and for spraying the inner surface of the wall of the enclosure. The first fluid spray bar has at least a first spray hole through which cleansing composition may be sprayed, the first spray hole being in fluid communication with the interior space of the spray bar. Additionally, the first spray hole provides a first tangential spray.

12 Claims, 12 Drawing Sheets

U.S. PATENT DOCUMENTS

| | | | | |
|---|---|---|---|---|
| 2007/0240252 | A1 | 10/2007 | Leonard et al. | |
| 2008/0017762 | A1 | 1/2008 | Leonard et al. | |
| 2008/0283624 | A1* | 11/2008 | Sawalski et al. | 239/1 |
| 2009/0000016 | A1 | 1/2009 | Sawalski | |
| 2009/0249533 | A1* | 10/2009 | Sawalski et al. | 4/223 |

FOREIGN PATENT DOCUMENTS

| | | | |
|---|---|---|---|
| WO | WO 99/66140 | | 12/1999 |
| WO | EP1507935 | B1 * | 7/2006 |
| WO | 2009034330 | A1 | 3/2009 |
| WO | WO 2009/027246 | A1 | 3/2009 |
| WO | WO 2009/034303 | A1 | 3/2009 |
| WO | WO 2009/034304 | A1 | 3/2009 |
| WO | WO 2009/034306 | A1 | 3/2009 |
| WO | WO 2009/034330 | A8 | 3/2009 |
| WO | WO2009034330 | * | 3/2009 |

* cited by examiner

FIG. 9
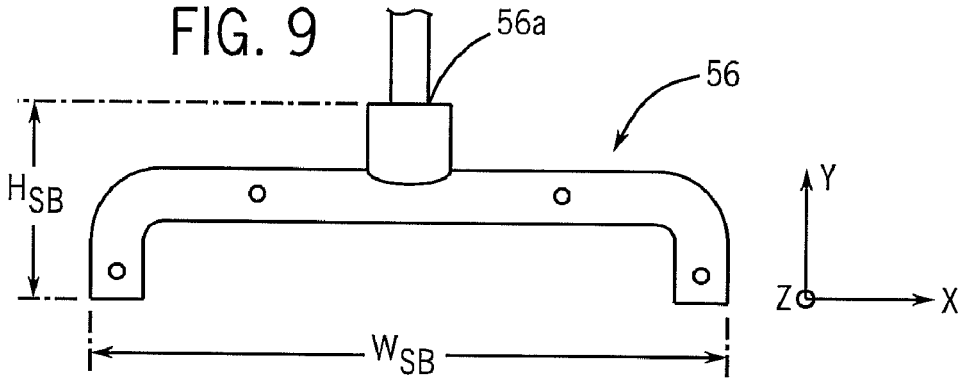
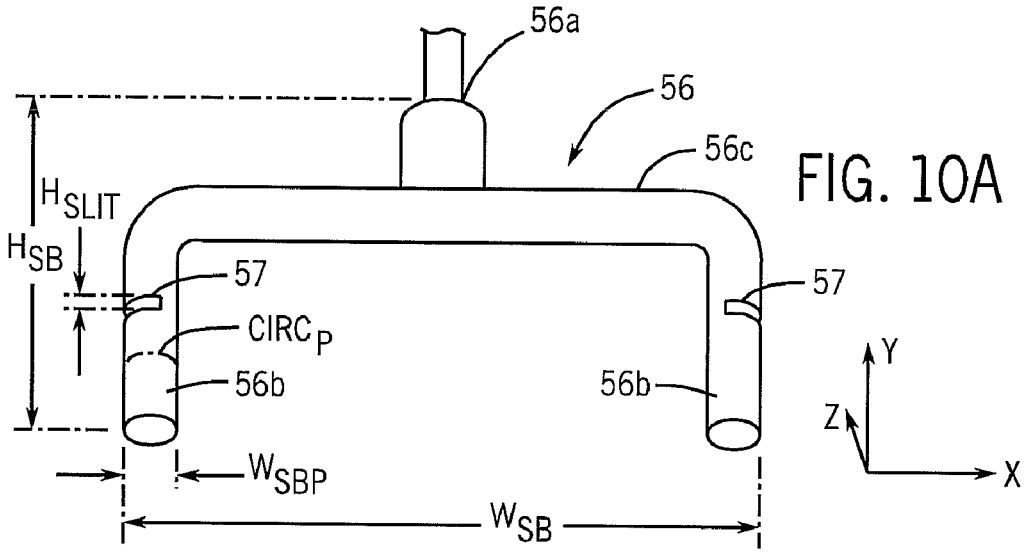
FIG. 10A
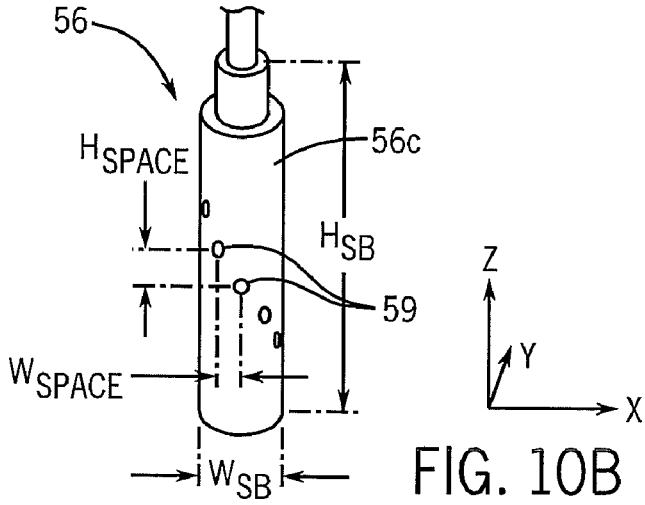
FIG. 10B

FIG. 11A
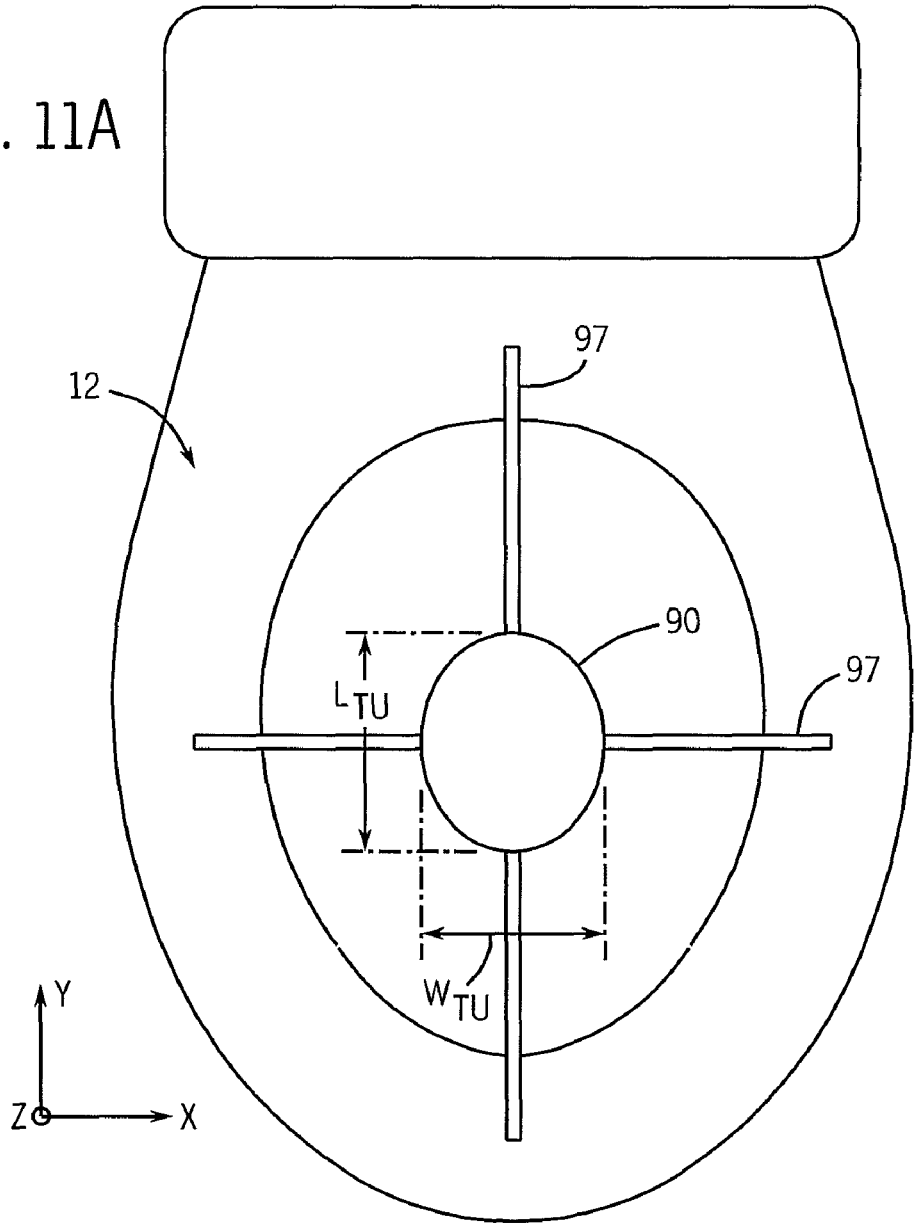
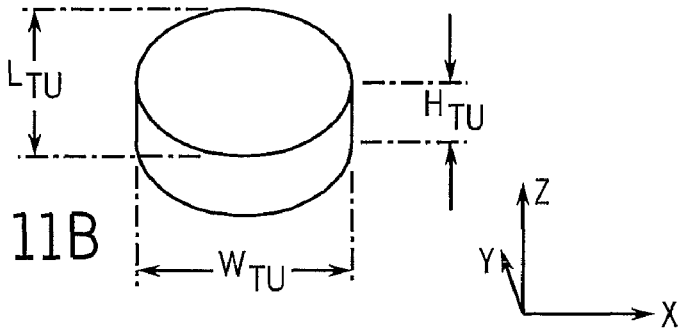
FIG. 11B

RELATIVELY COMPACT NON-CONTACT SPRAY TOILET BOWL CLEANING DEVICE

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to an automatic and/or manual toilet bowl cleaning device where the inner surface of the toilet bowl can be cleaned around the entire circumference of the toilet bowl. The device includes a spray bar that effectively delivers a cleaner around the circumference of a toilet bowl. The spray bar may include nozzles to direct the flow of the cleaner.

2. Description of the Related Art

Toilet bowls require care to prevent the buildup of unsightly deposits, to reduce odors, and to prevent bacteria growth. Traditionally, toilet bowls have been cleaned, deodorized, and disinfected by manual scrubbing with a liquid or powdered cleaning and sanitizing agent. This task has required manual labor to keep the toilet bowl clean.

In order to eliminate the detested manual scrubbing, various toilet bowl cleaner dispensers have been proposed. One type of dispenser comprises a solid block or solid particles of a cleansing and freshening substance that is suspended from the rim of a toilet bowl in a container that is placed in the path of the flushing water. U.S. Pat. No. 4,777,670 shows an example of this type of toilet bowl cleaning system. Typically, a portion of the solid block is dissolved in the flush water with each flush, and the flush water having dissolved product is dispensed into the toilet bowl for cleaning the bowl.

Other toilet bowl cleaning systems use a liquid cleaning agent that is dispensed into a toilet bowl. For example, U.S. Pat. Nos. 6,178,564 and 6,230,334, and PCT International Publication Nos. WO 99/66139 and WO 99/66140 all disclose cleansing and/or freshening devices capable of being suspended from the rim of a toilet bowl for introducing liquid active substances from a bottle into the flushing water with each flush. In these under the toilet rim devices, the liquid active substances are delivered downward from a reservoir to a dispensing plate that is supported by a base that is suspended from the toilet bowl rim. The device may be suspended from the toilet rim such that the flow of flush water from the toilet contacts the dispensing plate during a flush. The flush water carries the liquid active substances that are on the dispensing plate into the toilet bowl to clean and/or freshen the toilet.

Other toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim. Accordingly, such devices are often referred to as "under the rim"-type devices.

One disadvantage with traditional toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device.

U.S. Patent Application Publication Nos. 2007/0136937, 2007/0234470, 2007/0240252-2008/0017762, and 2009/0000016 (which are incorporated herein by reference) are owned by the owner of the current invention. These publications set forth, among others, an automatic and/or manual toilet bowl cleaning device where the inner surface of the toilet bowl is cleaned around the entire circumference of the toilet bowl.

In one example embodiment illustrated in U.S. 2007/0136937, the downstream end of a fluid supply conduit terminates in a nozzle capable of spraying the cleaning fluid outwardly onto the inner surface of the toilet bowl at locations below the toilet waterline, and/or locations at the toilet waterline, and/or locations above the toilet waterline, and/or locations under the toilet rim. A mounting clip at a location near the rim of the toilet bowl may attach the nozzle to the toilet bowl. The mounting clip can house a proximity or motion sensor that detects the presence of a person. Manual delivery of the cleaning fluid from a fluid supply container to the fluid supply conduit may be achieved by pressing a manual activation button that is in electrical communication with a control circuit that turns on an electrically driven pump that delivers the cleaning fluid into the fluid supply conduit and into the spray nozzle. Automatic delivery of the cleaning fluid from a fluid supply container to the fluid supply conduit can also be achieved pressing an activation button that is in electrical communication with a control circuit that controls on an electrically driven pump. Immediately after the user presses the activation button, fluid delivery occurs at selected time intervals (e.g. every eight hours). The proximity sensor that is in electrical communication with the control circuit can stop initiation of a spray cycle if a person is near the toilet bowl.

In addition to such under the rim devices, a number of devices have been described that deliver a composition via a spray nozzle to the toilet bowl. An exemplary device is described in PCT Pub. No. WO 2009/027246. Such a device may perform exceptionally well in the delivery of the cleanser and/or fragrance and/or composition to the inside of the toilet bowl. However, such a device may not effectively dispense chemicals and/or composition to the toilet while a consumer is using the toilet because of concerns that the consumer may be surprised by any contact with the composition. Existing spray-type devices often include one or more sensors to reduce or eliminate such concerns. Alternatively, some automated toilet products provide a relatively mild alkaline or acidic composition that will not irritate consumers' skin in anticipation of the composition contacting a consumer.

In view of the advances in the art provided by the devices of U.S. Patent Application Publication Nos. 2007/0136937, 2007/0234470, 2007/0240252, 2008/0017762 and 2009/0000016 even further improvements to this technology would be beneficial to consumers.

Thus, there is a need for an improved automatic or manual toilet bowl-cleaning device where substantially the entire inner surface of the toilet bowl may be cleaned while also providing a high level of comfort to the user, even while the user may be otherwise engaged in using the toilet. In some embodiments of the envisioned improved automatic toilet bowl-cleaning device, the device may be activated while a consumer is using the toilet and/or the device may be activated in such a way that there is little to no opportunity for discharging composition onto the user.

SUMMARY OF THE INVENTION

In a first nonlimiting embodiment, the present invention is directed to a device for providing cleansing composition to the inner surface of a wall of an enclosure with a fluid, the device comprising: a first fluid spray bar having an interior space for receiving fluid from a source of the fluid and for spraying the inner surface of the wall of the enclosure, wherein the first fluid spray bar comprises at least a first spray hole through which cleansing composition may be sprayed, the first spray hole being in fluid communication with the interior space of the spray bar, the first spray hole providing a first tangential spray.

In a second nonlimiting embodiment, the present invention is directed to a device for providing cleansing composition to the inner surface of a wall of an enclosure with a fluid, wherein the device comprising does not provide user interaction according to a Non Contact Spray Method.

In a third nonlimiting embodiment, the present invention is directed to a device for providing cleansing composition to the inner surface of a wall of an enclosure with a fluid, the device comprising: a first fluid spray bar having an interior space for receiving fluid from a source of the fluid and for spraying the inner surface of the wall of the enclosure, wherein the first fluid spray bar comprises at least a first spray hole through which cleansing composition may be sprayed, the first spray hole being in fluid communication with the interior space of the spray bar, the first spray hole providing a first tangential spray, the first tangential spray having an angle of from about 0° to about 36°.

BRIEF DESCRIPTION OF THE DRAWINGS

FIG. 9 is a top view of a toilet bowl cleaning device in accordance with an exemplary embodiment of the invention.

FIG. 10A is a perspective view of a fluid spray bar for a toilet bowl cleaning device in accordance with an exemplary embodiment of the invention.

FIG. 10B is a perspective view of a fluid spray bar for a toilet bowl cleaning device in accordance with an exemplary embodiment of the invention.

FIG. 11A is a top view of a cylindrical foam testing unit as the unit may be situated in a toilet bowl in accordance with an exemplary embodiment of the invention.

FIG. 11B is a perspective view of a cylindrical foam testing unit in accordance with an exemplary embodiment of the invention.

Like reference numerals will be used to refer to like parts from Figure to Figure in the following description of the drawings.

Figure 1:
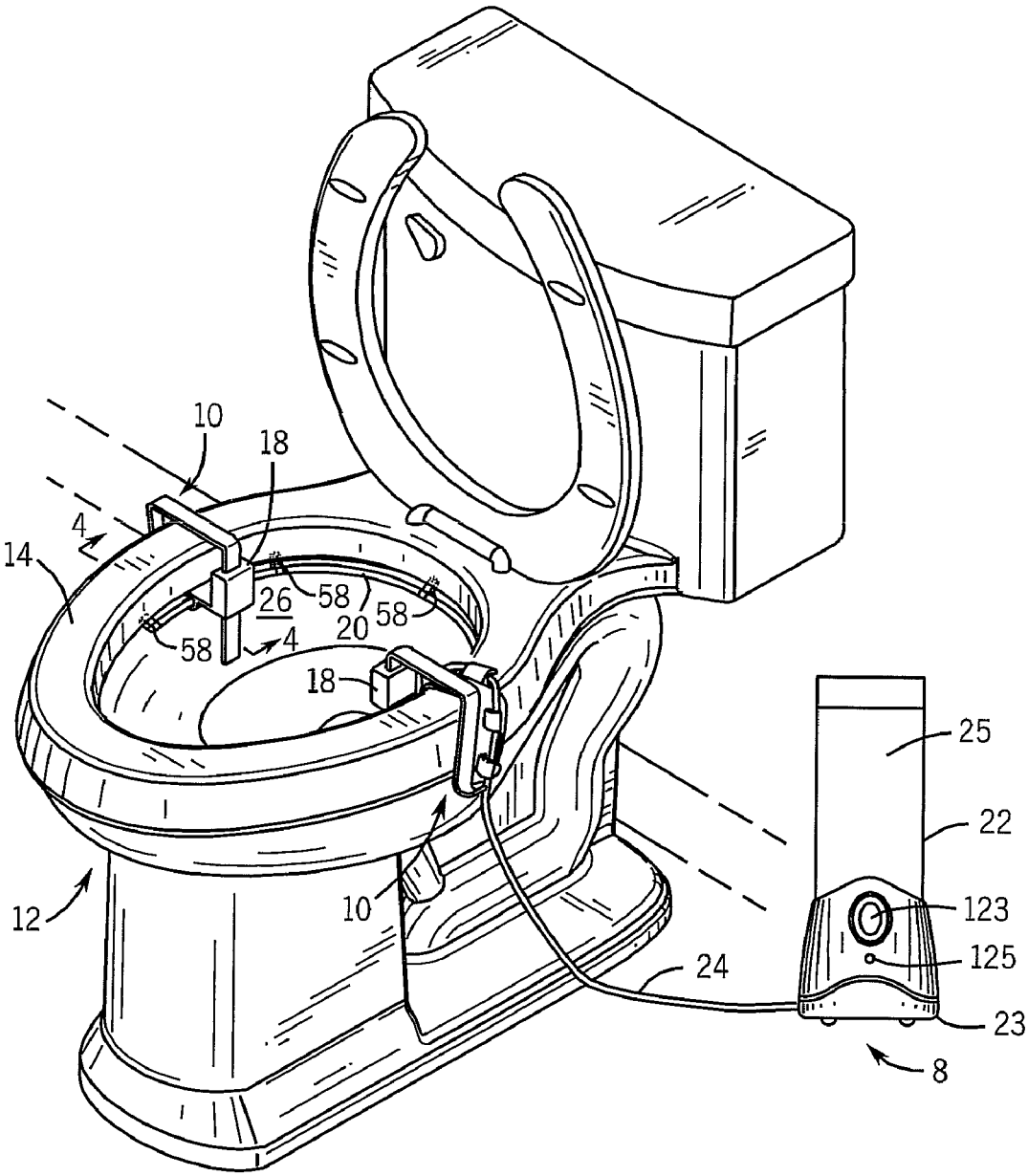
FIG. 1 is a perspective view of a toilet bowl cleaning device mounted to a toilet in accordance with an exemplary embodiment of the invention.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE INVENTION

A cleaning device according to the invention may be used to dispense cleaning fluid or some other cleaning composition into an enclosure and/or the inside surface(s) of an enclosure. An enclosure may include a toilet bowl, shower stall, bathtub, and the like. Various nonlimiting embodiments of the invention will now be described with reference to the Figures.

The foregoing needs may be met with a toilet bowl cleaning and/or deodorizing device according to the invention that delivers a chemical into the toilet bowl. The term "chemical" or "chemistry" means one or more compounds and/or combination of ingredients. Various cleaning and/or deodorizing chemicals are suitable for use with a toilet bowl cleaning device according to the invention. The toilet bowl cleaning and/or deodorizing device includes appropriate chemistry and a dispensing system. As used herein, the term "cleaning" may also include sanitizing and/or disinfecting, and the term "deodorizing" may also include freshening, odor absorbing, providing perfume and/or any function related to improving a user's olfactory experience.

Regarding the chemistry, a chemical may be provided onto the inner surface of the toilet bowl and/or directly into the toilet water to clean and/or freshen the toilet bowl. If applied to the inner surface of the toilet bowl, the chemical will typically be a liquid (single or multiple chemistries). If added to the toilet water, the chemistry can also be a liquid (single or multiple chemistries) that is added to the water to act as a preventive, or to create an environment that will work to clean the toilet automatically.

With respect to the dispensing system, the system includes several subsystems that may provide a suitable means for applying the appropriate chemistry to the inner surface of the toilet bowl to conduct the cleaning process. The dispensing system may include, but not be limited to: (i) a chemistry storage container; (ii) a chemical propulsion system; (iii) a chemical delivery system; and (iv) a toilet interface. These subsystems work together to deliver the appropriate chemistry (using predetermined amounts) to deliver the desired consumer benefit.

The chemistry storage container may be used to hold and store the chemistry used to clean the toilet bowl. Non-limiting examples include a standard plastic bottle, such as that found on a trigger sprayer.

The chemical propulsion system provides a method of providing the appropriate energy to the chemistry to move it through the delivery system so that it can move from the storage container to the appropriate area within the toilet bowl. Examples of this subsystem include a pump or pumping mechanism to move a liquid such as a vein pump, bellows pump, impeller driven pump, piston pump, peristaltic pump or gear driven pump. In another embodiment, the chemical may be provided in a pressurized system wherein the drop in pressure between the chemistry storage container and the ambient surroundings provides an adequate gradient to effectively dispense the chemical composition.

The chemical delivery system provides a method of moving chemistry from its storage container, or other source of fluid, to the appropriate area within the toilet bowl. This delivery subsystem can include a hose and a sprayer (e.g., one or more spray bars).

The toilet interface provides a means and method of attachment to the toilet to keep the hose out of the way, keep it uncrimped, and secure the spray bar into place on the toilet rim or toilet lid.

In one exemplary embodiment, the toilet bowl cleaning and/or deodorizing device includes a replaceable plastic transparent container, or other source of fluid, filled with a toilet bowl cleaning solution (chemical composition) that uniquely locks into an inverted position in a container holder base dispensing unit. The container holder base accepts a refill container, or other source of fluid, with a unique lock and key and spill-proof closure. The device detects when a container is inserted into the container holder base and available for safe dispensing. A button release system secures the container through a locking tab that engages the container closure. The base dispensing unit activates a pump to automatically transfer fluid from the container through a conduit into a spray bar assembly approximately three times a day. The spray bar assembly may be attached to the rim of the toilet bowl with the cleaning fluid dispenser spray bar inside the toilet bowl and below the inner rim. A functional dispensing cycle results in a continuous coating of chemical from the plastic container onto the walls of the toilet bowl from the water line up to the bottom of the rim.

In one aspect, the invention provides a device for spraying an inner surface of a wall of an enclosure with a fluid. The enclosure can be one of a tub, shower and/or toilet. In another aspect, the device includes one or more fluid spray bars wherein each spray bar may include one or more spray nozzles, spray holes and/or nozzle bodies through which the fluid (e.g., chemical composition and/or cleaning composition) can be sprayed. In a particular nonlimiting embodiment, the spray bar has an interior space for receiving fluid from a source of the fluid and for spraying the inner surface of the wall of the enclosure. The spray nozzles are in fluid communication with the interior space of the spray bar. At least one of the spray nozzles has a nozzle body defining a fluid path in fluid communication with the interior space, and the nozzle body extends away from an outer surface of the spray bar.

In an embodiment, a controller is in electrical communication with the pumping apparatus. The controller executes a stored program to activate the pumping apparatus at an end of a predetermined time interval stored in the controller. The controller may also be in electrical communication with one or more sensor mechanisms wherein the sensor mechanisms may provide a means for detecting the presence (or lack thereof) of a user. As described above, many automatic dispensing devices for bathroom-type enclosures, such as WO 2009/034306(A1), WO 2009/034303(A1), WO 20091034330(A1), WO 2009/034304(A1), and WO 2009/0276246, do not provide a suitable means for accounting for the presence (or lack thereof) of a user. Applicants unexpectedly observe that, as an alternative/in addition to the use of a sensor mechanism, it may be desirable to provide a device that may spray cleansing composition from a nozzle or other means for discharge. Further, it is even more surprisingly observed that in such a device, such a device may be especially favored from a consumer standpoint if such device may distribute composition to a substantial portion of the inner surface of the toilet bowl.

It is also thought that bathroom enclosures, residential bathroom enclosures in particular, may be particularly difficult to monitor by a sensor because of limitations in the sensor device and/or unique ambient conditions in each bathroom. For example, certain bathrooms may be unusually warm, such that an IR detector may not operate properly, or that the sensor itself may become soiled and thus become non-functional, etc. The inventors observed that due to the size and layout of a residential bathroom, many enclosures may be relatively warm and/or humid, thus causing unusual difficulties when designing and/or using a sensor. Thus, the inventors have found a unique solution to the problem of accidental discharge of the chemical composition by providing new and unique spray bar configuration(s). In some embodiments, the spray bar is provided such that the spray device may further comprise spray nozzles (or some other means for discharge) wherein the chemical composition is provided to the inner surface of the enclosure in such a way that there is no contact with the user during discharge of the chemical composition.

These and other features, aspects, and advantages of the present invention will become better understood upon consideration of the following detailed description, drawings, and appended claims.

Pump System

The spray devices described herein are provided such that the devices deliver about 7.5 g of cleaning composition having a viscosity (dynamic viscosity) of about 1.002 (N s/m$^2$)$\times 10^{-3}$, a density of about 0.9982 g/cm$^3$, and using a piston pump that provides an output pressure of about 30 psi to about 40 psi (measured at the nozzle, or outlet point). The 7.5 g of cleaning composition may be delivered in about 1.3 seconds. The spray devices are tested at room temperature (about 20° C.).

Certain known automatic toilet bowl cleaning devices provide a constant stream or spray that is directed at the surface of an enclosure, such as a toilet, by using a rotating nozzle or other similar means to maximize the coverage to the surface of the toilet. Other known automatic toilet bowl cleaning devices may provide a stream or spray that is directed towards the center of the toilet bowl in order to provide coverage throughout the center of the toilet bowl and to the opposite side of the toilet bowl from the spray origin. Such a device is described in WO 2009/027246. An exemplary device that may be available for retail sale is the Scrubbing Bubbles® Automatic Toilet Bowl Cleaner (S.C. Johnson & Son, Racine, Wis.). However, as described earlier, one limitation of a device that provides from one side of a toilet to another is that such a device tends to create a relatively high likelihood that a user will get sprayed if a user is sitting on the toilet.

Discrete Spray Elements

FIG. 1 provides a nonlimiting embodiment of a fluid spray bar assembly (indicated generally at 20) for spraying an inner surface of a toilet bowl 26 with a chemical. The device may comprise at least a first fluid spray bar assembly 20 including a clip 10 for mounting a fluid spray bar assembly 20 to an enclosure, here a toilet bowl 12. The clip 10 is secured to the rim 14 of the toilet bowl 12 by a hook 16. A base 18 is supported by the hook 16. The base includes a tab 50, which creates a channel 54 for engaging the fluid spray bar assembly 20. A container 22 supplies fluid and/or some embodiment of a chemical composition and/or chemical cleanser 25 via a fluid conduit 24 to the fluid spray bar assembly 20 to be dispensed onto the inside surface 26 of the toilet bowl 12. The fluid 25 can be supplied from the container 22 to the fluid spray bar assembly 20 by way of a pumping apparatus or by providing some sort of pressure to the container 22. Such pressure source and/or controller to actuate a pumping apparatus may be housed in a container holder 23. The pressure source, pumping apparatus, controller, and container holder 23 are described in further detail below.

Figure 2:
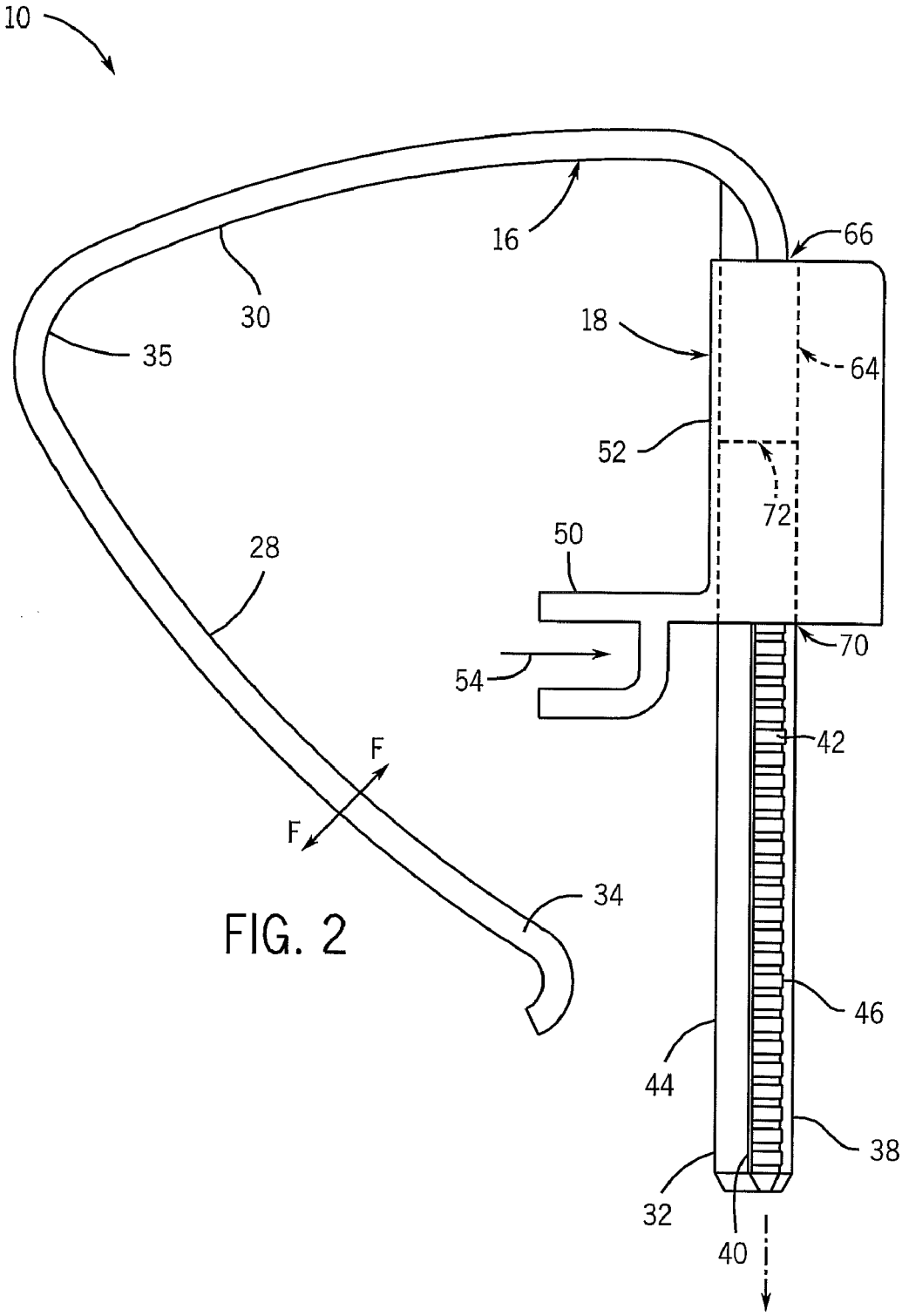
FIG. 2 is a side elevation view of the clip of FIG. 1.

Turning to FIG. 2, the clip 10 comprises a hook 16 for supporting the base 18 and attaching the clip 10 to the toilet bowl 12 has three main segments. A bowl segment 28, a top rim segment 30, and an inner rim segment 32. In one embodiment, the three segments 28, 30, 32 may be integrally molded from plastic (e.g., polyethylene or polypropylene) and form a flexible hook 16. In the embodiment shown, the bowl segment 28 has a substantially rectangular cross section and a flared elastomeric gripping foot 34. The bowl segment 28 extends substantially vertically upward and transitions into the top rim segment 30 at a flexible elbow 35 that allows the hook 16 to flex predominantly in the F-F direction to secure the clip 10 to toilet bowls of various shapes and sizes. The top rim segment 30 has a substantially rectangular cross-section and extends horizontally across the rim 14 of the toilet bowl 12 where it transitions into the inner rim segment 32 at another flexible elbow 36, also allowing the hook 16 to flex. The inner rim segment 32 extends vertically downward from the elbow 36 and is configured to engage and support the base 18.

The inner rim segment 32 of the hook 16 has a front face 38 and a rear face 40 joined by two short side faces 42. A rib 44 protrudes from the rear face 40 of the inner rim segment 32 and extends the length thereof. The rib 44 limits the angle of rotation of the base 18 with respect to the hook 16. The rib of the example embodiment has a substantially rectangular cross-section, however, the rib 44 may have a curved cross-section, a square cross-section, comprise two spaced apart members, and the like. Additionally, the rib 44 need not extend the length of the inner rim segment 32 provided the rib 44 engages the base 18 throughout the desired adjustable range of the base. The short side faces 42 have ratchet teeth 46 used in conjunction with the base 18 to restrain vertical movement of the base 18 along a vertical axis 48. Other restraints may be used, such as a friction fit between the hook 16 and base 18, or the like.

The base 18 has a tab 50 that extends rearward away from the base 18. The tab 50 helps orientate the base 18 with respect to the rim 14 when the clip 10 is mounted to the toilet bowl 12, as discussed below. The tab 50 may be one continuous member as shown in the example embodiment, or alternatively, the tab 53 may include a plurality of members extending from the base 18. The base 18 is preferably molded from plastic (e.g., polyethylene or polypropylene). The tab 50 includes a channel 54 for engaging the fluid spray bar 56. The channel 54 opens away from the base 18.

The base 18 includes an opening 64 for receiving the inner rim segment 32 of the hook 16. The opening 64 includes a slit 66 for receiving the rib 44 having an entrance 68, an exit 70, and intermediate position 72 (which may or may not be equidistant from the entrance 68 and the exit 70). The width of the slit 66 decreases from the entrance to the intermediate position 72 and increases from the intermediate position 72 to the exit. In one embodiment, the intermediate position 72 is approximately half way between the entrance 68 and the exit 70; however, the narrowest point need not be halfway between the entrance 68 and exit 70, but may occur anywhere between the extremes of the slit 66. Additionally, the maximum width of the slit 66 may vary depending on the desired degree of adjustment of the base 18 with respect to the hook 16. If greater rotational adjustment of the base 18 is desired, the maximum width of the slit 66 at the entrance 68 and exit 70 may be increased; alternatively, or in addition, the width of the rib 44 may be decreased. In another embodiment, a spring and/or elastic band and/or other resistance device, may be included in the rib to provide some sort of force to help the clip 10 maintain a strong fit to the toilet bowl 12 despite the adjustability of the clip 10.

With general reference to FIG. 2, an exemplary clip 10 may be mounted follows: The clip 10 is secured to the rim 14 of the toilet bowl 12 by urging the hook 16 in the F-F direction away from the base 18 and placing the clip 10 over the rim 14. Once the hook 16 is secured, the base 18 is slid along the vertical axis 48 up the hook 16 and ratchet teeth 46 until the tab 50 engages the underside of the rim 14. In another embodiment, a spring, elastic band, or other resistance means may be provided to allow for a relatively tightly secured fit between the clip 10 and the rim 14. In yet an alternative embodiment, the clip 10 may be provided such that the weight of the clip is approximately equal at opposite sides to provide a counterbalance.

The fluid spray bar 56 slides into the channel 54 on the base 18 of the clip 10. The fluid spray bar 56 is held securely in position by the channel 54.

In one embodiment, the spray holes 59 have a diameter of from about 0.4 mm to about 1.2 mm. In another embodiment, the spray holes 59 have a diameter of from about 0.5 mm to about 1.0 mm. In another embodiment still, the spray holes have a diameter of from about 0.6 mm to about 0.8 mm. It is thought that by providing a smaller spray hole size, smaller particles are released. Because small particles have less mass than large particles, such particles are more likely to drift from their intended path, thus running the risk of unwanted contact with the user and/or not reaching the intended surface for coverage. Such small particles, or mist, may be suitable for fragrancing applications, but inventors observe such surprising results to provide optimal coverage for cleansers or cleansing applications. Further, spray particle size increases as spray pressure decreases. The spray pressure may be selected to provide a spray that provides adequate coverage within the intended enclosure. In other words, that is, adequate pressure must be provided to avoid misting the chemical composition, but at the same time able to provide coverage to the surface.

In an alternative embodiment, a fluid spray bar may be provided with slits instead of holes. In one embodiment, a slit may be provided such that the slit is less than about 80% of the width and/or circumference of the spray bar (or the portion of the spray bar) where the slit is located (for example, $circ_p$, FIG. 10A).

Figure 3:
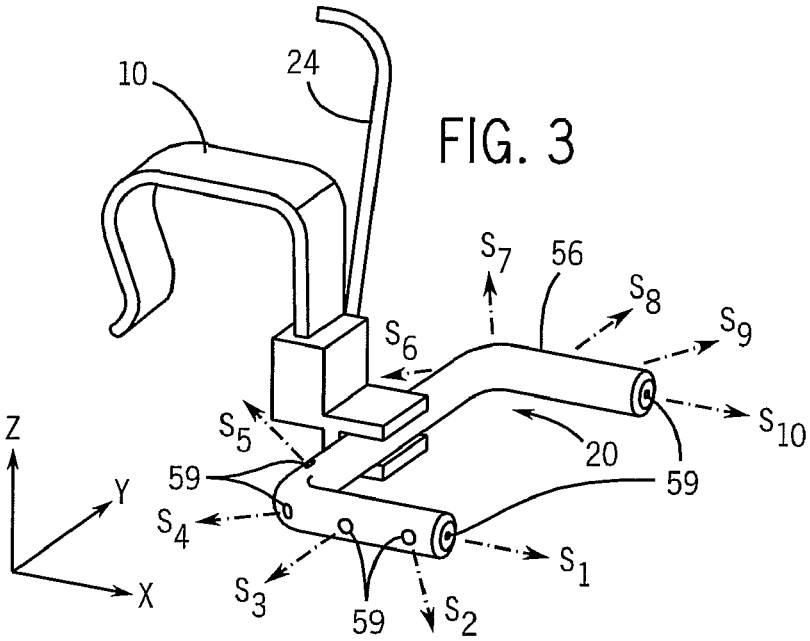
FIG. 3 is a perspective view of a fluid spray bar for a toilet bowl cleaning device in accordance with an exemplary embodiment of the invention.
Figure 4:
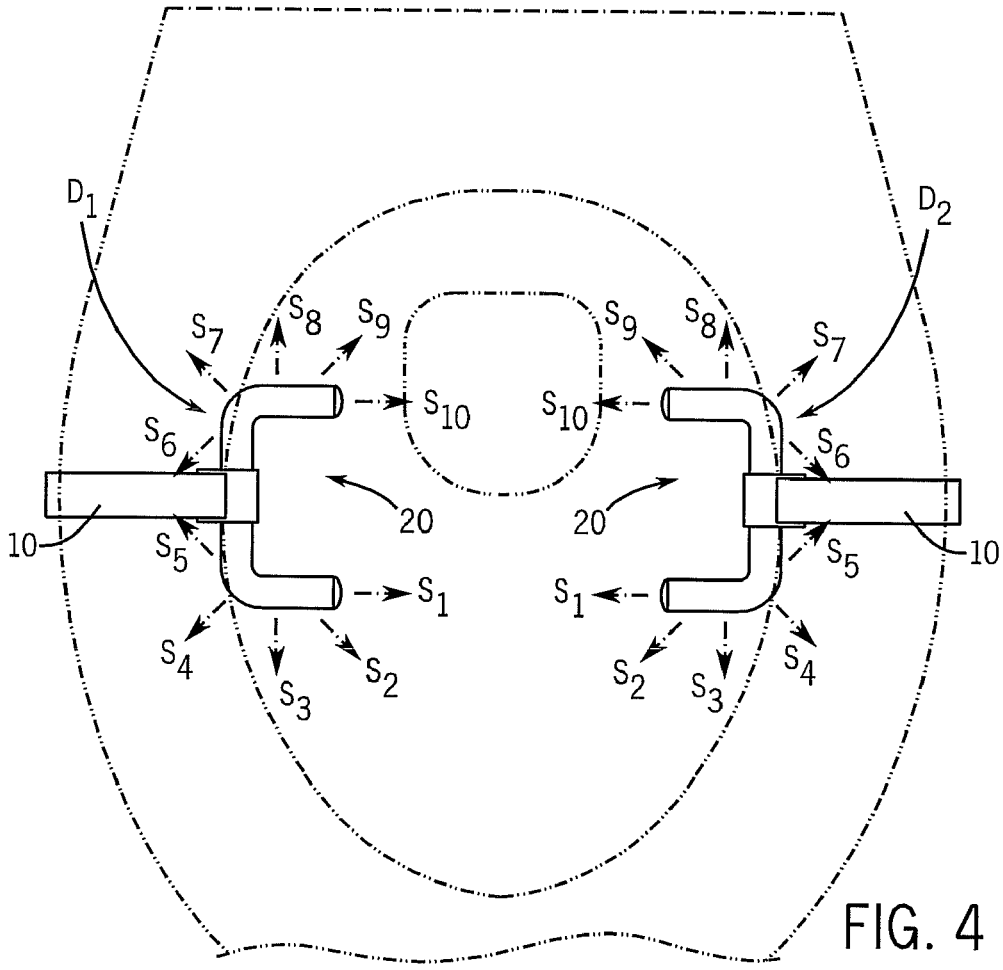
FIG. 4 is a side elevation, fragmentary view taken along line 4-4 of FIG. 1 showing a clip and spray bar assembly of the toilet bowl cleaning device in accordance with an exemplary embodiment of the invention.

Turning now to FIGS. 3 and 4, another alternative exemplary embodiment of the fluid spray assembly 20 is described. In the exemplified embodiment, two separate fluid spray assemblies 20 may be provided onto the toilet bowl 12 (FIG. 4). The fluid spray assembly 20 includes a relatively short, U-shaped fluid spray bar 56 in fluid communication with a plurality of spray nozzles 62. The fluid spray bar 56 may be molded from a flexible plastic (e.g. polyethylene and polypropylene). The fluid spray bar 56 defines a fluid path from the fluid conduit 24. The spray nozzles 62 have nozzle bodies 58, which may be molded from an engineering plastic (e.g. polyacetal, acetal resin, polytrioxane, polyformaldehyde, and paraformaldehyde). The nozzle bodies define a fluid path from the interior space 57 of the fluid spray bar 56. A first fluid spray bar 56 may be positioned along the first side $D_1$ of the toilet (FIG. 4) and a second fluid spray bar 56 may be positioned along the second side $D_2$ of the toilet. In the embodiment shown, the adjacent spray nozzles 62 (and subsequently the spray holes 59) are provided such that the spray is set at different angles in such a way that the streams ($S_1$ through $S_{10}$, FIG. 4) do not cross.

As mentioned above, it is highly desirable to avoid accidentally spraying a user who may be using the toilet during a discharge of composition from the device. However, it is against traditional thinking to be able to provide a high level of coverage of cleansing composition to the inner surface of a toilet bowl while also avoiding spraying the user. The present invention surprisingly resolves this issue by providing a relatively high level of coverage to the inner surface of a toilet bowl with a minimal number of parts and while also avoiding any discharge of cleaning composition onto the user using the toilet during a spray cycle.

Also advantageously provided by the present invention is a device that provides a relatively high degree of coverage to the inner surface of a toilet bowl wherein the number of parts required by the device is relatively low. By providing a device with a relatively high level of coverage, but relatively few parts, it is thought that consumers will be more likely to purchase the product due to its presumably lower cost and relative ease of use and/or maintenance and/or installation.

Tangential Spray Component

Figure 5:
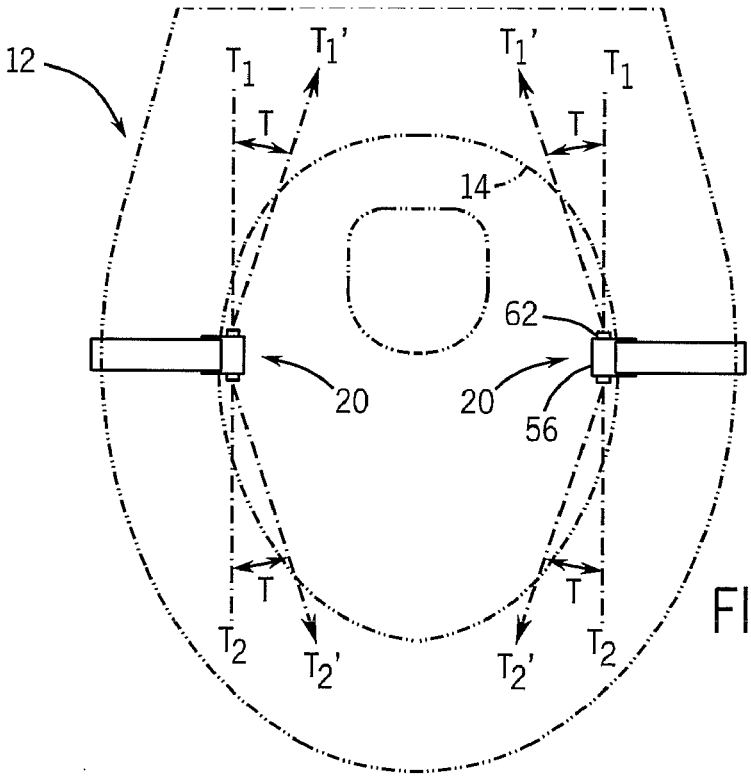
FIG. 5 is a top view of the toilet bowl cleaning device and its associated spray pattern in accordance with an exemplary embodiment of the invention.

FIG. 5 provides an exemplary embodiment of a fluid spray assembly 20, wherein the fluid spray assembly 20 comprising at least one fluid spray bar 56. In the embodiment shown in FIG. 5, the fluid spray bar 56 comprises at least one spray nozzle 62 wherein the spray nozzle 62 is provided in such a way that spray is directed at an angle relatively tangential to the rim 14 of the toilet bowl 12 at the spray nozzle 62 (or other point of discharge). An exemplary tangential line is shown in FIG. 5 as $T_1$. By substantially tangential, it is intended to mean that the spray may deviate from the tangential line $T_1$ towards the center of the toilet bowl 14 (shown as $T_1'$). This so-called tangential spray T (the angle between $T_1$ and $T_1'$, FIG. 5) may be from about 0° to about 36°. In another embodiment, the tangential spray T may be from about 0° to about 20°. In still another embodiment, the tangential spray T may be from about 0° to about 10°.

Figure 6:
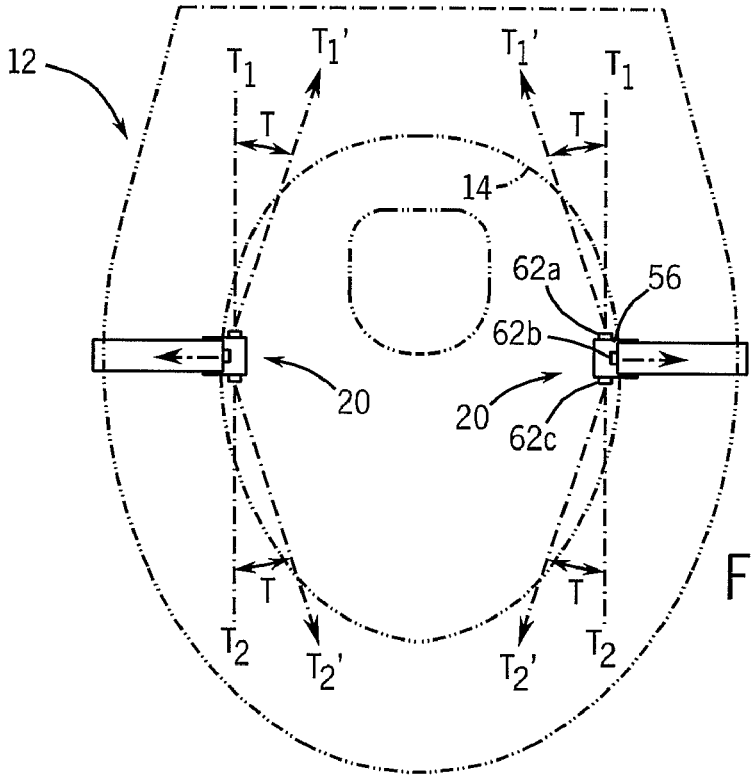
FIG. 6 is a top view of the toilet bowl cleaning device and its associated spray pattern in accordance with an exemplary embodiment of the invention.

In the embodiment shown in FIG. 6, the fluid spray bar 56 comprises first, second and third spray nozzles (62*a*, 62*b*, 62*c*) in which the first spray nozzle 62*a* directs spray in a substantially tangential spray, the second spray nozzle 62*b* provides a spray in the direction of the rim 12 towards the inner surface of the toilet bowl 14, and the third spray nozzle 62*c* provides tangential spray in the direction substantially opposite the tangential spray of the first nozzle 62*a*. In some embodiments, the second spray nozzle 62*b* directs spray that is substantially perpendicular to the tangential spray of the first and/or third spray nozzles (62*a*, 62*c*, respectively). In some embodiments, the fluid spray bar 56 may comprise at least a first spray nozzle wherein that spray nozzle provides tangential spray. In other embodiments, there is a second spray nozzle that provides tangential spray in the direction substantially opposite that of the first spray nozzle ($T_2$, $T_2'$, respectively). By substantially opposite, it is intended to mean in a direction away from, a relative spray. For example, if one tangential spray is substantially parallel to the +y direction, then a substantially opposite spray is meant to be directed in a direction that is substantially parallel to the −y direction. However, it is not intended to require that there be a 180° difference between a first spray direction and a second spray direction that is in the substantially opposite direction.

One of skill in the art will appreciate that any number of spray nozzles may be provided on the fluid spray bar 56 that are suitable based on manufacturing limitations. In certain embodiments, the spray nozzles which do not provide tangential spray are directed towards the inner surface of the toilet 12 in the general direction of the rim 14. In certain other embodiments, a spray nozzle which directs spray towards the inner surface of the toilet in a direction that may be substantially perpendicular to a tangential spray may be said to be directing spray in a "substantially normal" direction.

Spray Coverage within the Toilet Bowl Method

Figure 7:
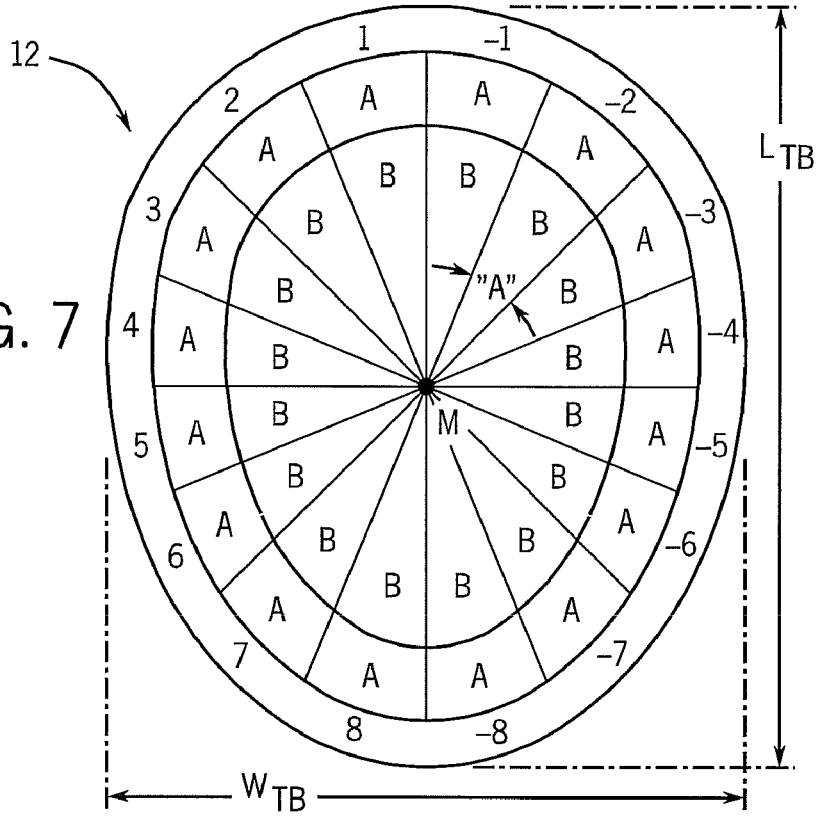
FIG. 7 is a schematic top view of a toilet bowl and its relative quadrants in accordance with an exemplary embodiment of the invention.

For purposes of the present invention, in order to gauge the efficacy of a spray device 10 to provide coverage to the inner surface of a toilet bowl 12, the inner surface of the toilet 12 may be divided into quadrants to provide a basis for calculating spray coverage. FIG. 7 shows an exemplary embodiment of a toilet 12 which has been divided into quadrants. The toilet bowl which is used in the experiments is a Kohler Memoirs® (Kohler Co., Kohler, Wis.). The midpoint M of the width $W_{TB}$ and length $L_{TB}$ of the toilet bowl (as measured in the X-Y plane) is calculated and, from the midpoint M, the toilet is divided into wedges having an angle, A, of about 22.5° to provide 16 quadrants. Each of the 16 quadrants is divided into 2 radial quadrants. The quadrants are identified by a number and a letter (FIG. 7), wherein the top ("A") quadrants are taken approximately 1.5" from the inner-edge of the rim. The relative efficacy of different fluid spray bars may be gauged by calculating the number of quadrants that are provided with cleaning composition.

A quadrant is determined to have been reached by the spray if there is any visually discernable fluid (an average observer at a distance of 4 ft. away) in a given quadrant, or if there is more than 0.20 g. of fluid within a quadrant.

Non-Contact Spray Method

In order to estimate whether a user may be sprayed while using the toilet bowl, a testing unit may be placed in the opening of the toilet and left there during a spray or dispensing cycle to determine whether the device sprays the user during a spray or dispensing cycle.

FIG. 11A shows a cylindrical foam testing unit 90 having an oblong surface shape (X-Y plane). The cylindrical foam testing unit 90 has a width $W_{TU}$ of about 8" and a length $L_{TU}$ of about 9.5". The cylindrical foam testing unit 90 has a height $H_{TU}$ of about 5" (FIG. 11B). Four 12" wooden skewers 97 are placed about 4" deep at an approximately equal spacing around the outer edge of the unit 90. A stock toilet seat which accompanies the Kohler Memoirs® toilet (Kohler Co., Kohler, Wis.) is used. The skewers 97 are placed into the unit 90 in such a way that the unit 90 hangs about 4" below the height of the toilet seat.

Once the unit 90 is situated on the toilet, a dispense cycle may be initiated using the device 20. To provide for ease of visually observing coverage within the toilet bowl, dyed water may be dispensed from the device 20. About 25 oz. of water is mixed with about 2 oz. of blue food coloring to provide dyed water. The dyed water is provided into the container of the toilet pump system. An exemplary pumping system is sold under the Scrubbing Bubbles® Automatic Shower Cleaner name (S.C. Johnson & Son, Racine, Wis.). A particular embodiment of a pump is described in greater detail below. One of skill in the art will appreciate that the particular pumping mechanism is not critical to this testing method so long as the cleansing composition may be consistently dispensed each time. The toilet pump system is provided such that it provides a pressure of from about 30 psi to about 40 psi (measured at the nozzle, or outlet point) and dispenses about 7.5 g of dyed water during a spray cycle in about 1.3 seconds.

After the dispensing of the dyed water, the unit 90 is removed from the toilet seat and the unit 90 is visually inspected to determine whether dyed water dispensed by the device 20 has contacted the unit.

A device 20 that dispenses dyed water such that the dyed water contacts the unit 90 is designated as "interacts with the user during dispensing". A device 20 that dispenses dyed water such that the dyed water does not contact the unit 90 is designated as "does not interact with the user during dispensing."

Exemplary Spray Nozzles

One of skill in the art will appreciate that there may be an infinite number of configurations of a fluid spray bar 56 that will provide an acceptable level of coverage to the inner surface of an enclosure such as a toilet bowl. For example, one could provide a device 20 having a dozen or more fluid spray bars 56 to provide an excellent level of coverage. Unfortunately, although some manufacturers would provide such a device, consumers may not appreciate it due to the relative complexity associated with attaching a dozen fluid spray bars to their toilet bowl. Further, from a manufacturing standpoint it may be the most efficient for a producer of such a device to provide the most compact device possible in order to minimize costs and simplify the overall user experience. The present invention addresses this newly discovered problem by providing a relatively compact and efficient device.

Figure 8:
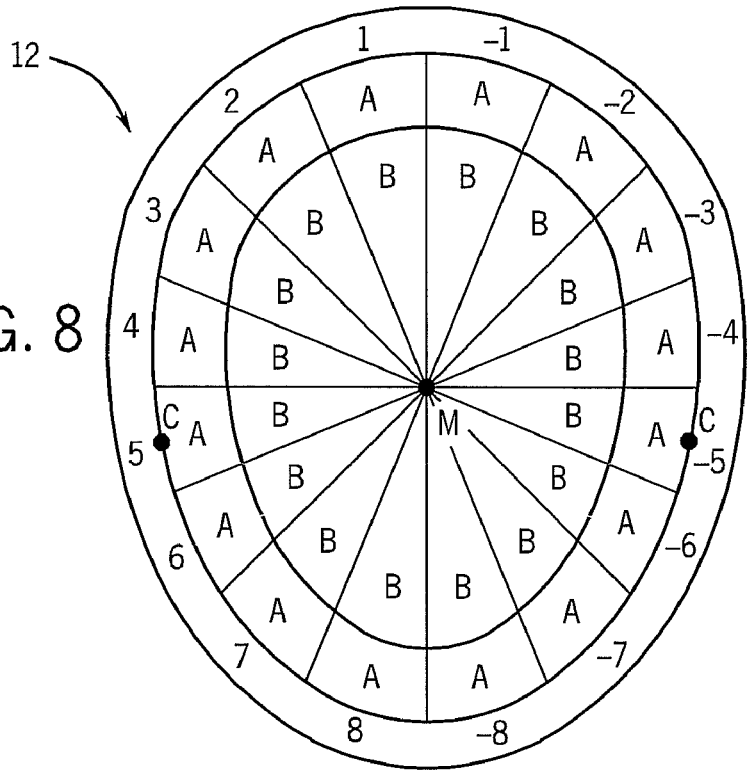
FIG. 8 is a schematic top view of a toilet bowl and its relative quadrants in accordance with an exemplary embodiment of the invention.

In some embodiments of the present invention, the device 20 comprises four or less fluid spray bars 56. In one embodiment, the device 20 comprises between two and four fluid spray bars 56. In another embodiment, the device comprises two fluid spray bars 56. As described earlier, in one embodiment, the fluid spray bars 56 may be positioned symmetrically about any axis on the toilet bowl. In another embodiment, the fluid spray bars 56 may be positioned at an approximately equal spacing about the toilet bowl. In another embodiment still, the fluid spray bars 56 may be positioned in a non-symmetrical or non-equidistant configuration along the toilet bowl. In some non-limiting embodiments, a device 20 having two spray nozzles 56 may be placed approximately at the center (C) of the 5 and −5 quadrants along rim of the toilet bowl nearest to the inner surface of the toilet (FIG. 8).

A device having a multiple fluid spray bar configuration may be contrasted to the device of U.S. Pat. App. Pub. No. 2007/0136937. The device in U.S. Pat. App. Pub. No. 2007/0136937 uses a single rotary spray device to provide coverage to the entire inner surface of the toilet bowl by providing, among other things, spray across the inner surface of the toilet. However, as described above, the present invention provides tangential spray, rather than spray across the toilet.

In some embodiments, the fluid spray bars of the present invention provide the user with a compact and efficient solution for the onerous task of cleaning a toilet. In some embodiments, the fluid spray bar 56 may have a height ($H_{SB}$) of from about 1 cm to about 7 cm (FIG. 9). In other embodiments, the fluid spray bar 56 may have a height ($H_{SB}$) of from about 2 cm to about 5 cm. The height of the fluid spray bar $H_{SB}$ may be measured from the inlet port 56*a* to the bottom portion of the spray bar. In some embodiments, the fluid spray bar 56 may have a width ($W_{SB}$) of from about 0.5 cm to about 25 cm (FIG. 9). In another embodiment, the fluid spray bar 56 may have a width ($W_{SB}$) of from about 5 cm to about 20 cm. In yet another embodiment still, the fluid spray bar 56 may have a width ($W_{SB}$) of from about 10 cm to about 20 cm. The height of the spray bar 56 is measured along the Y-axis of the fluid spray bar 56. The width of the spray bar 56 is measured along the X-axis of the fluid spray bar. The height and width of the fluid spray bar 56 is relative and may not necessarily be related to the positioning of the fluid spray bar 56 in the toilet bowl.

Exemplary Embodiments of Spray Nozzles

As described herein, the relative "height" of a fluid spray bar refers to the dimension of the fluid spray bar that is substantially in the Z-direction (relative to the toilet bowl).

As described herein, the relative "width" of a fluid spray bar refers to the dimension of the fluid spray bar that is substantially in the Y-direction (relative to the toilet bowl).

A fluid spray bar 56 may be mounted such that the spray bar 56 lies in a relatively "vertical" or relatively "horizontal" position with respect to the rim 14 of the toilet bowl 12.

Figure 15A:
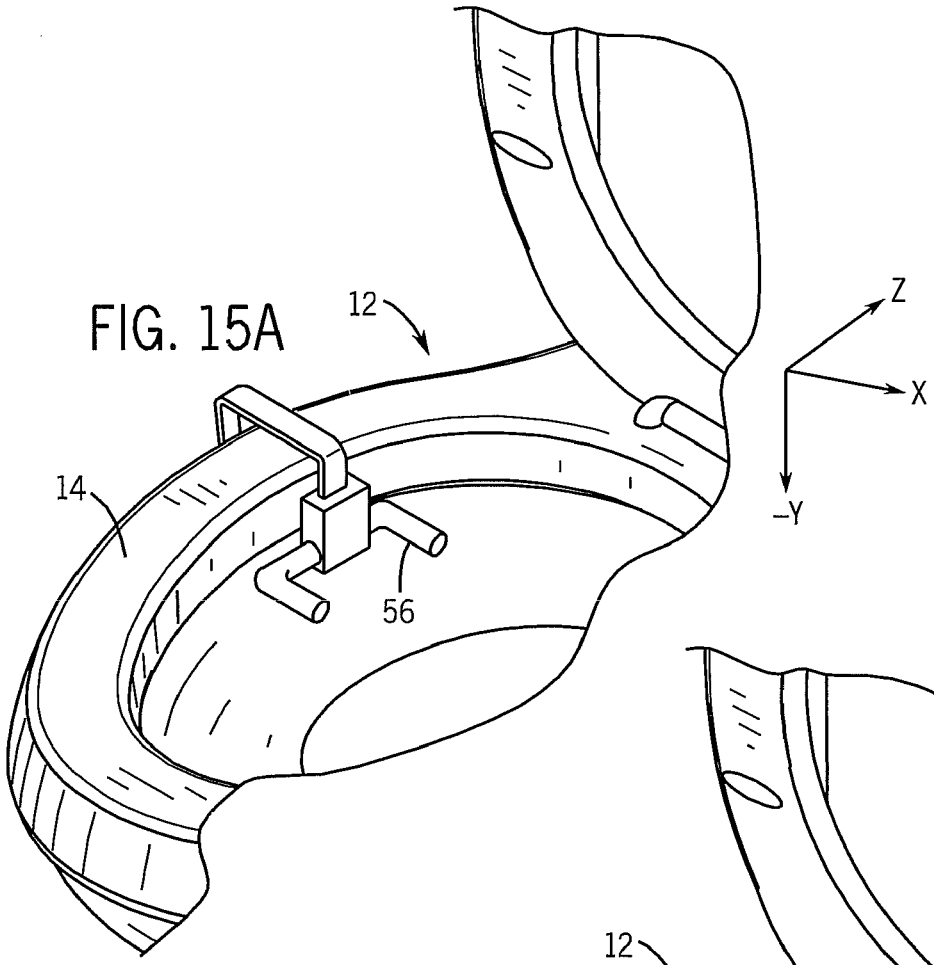
FIG. 15A is a perspective view of a fluid spray bar for a toilet bowl cleaning device in accordance with an exemplary embodiment of the invention.

FIG. 15A shows a fluid spray bar 56 wherein the fluid spray bar 56 is mounted with its relatively longest dimension is substantially parallel with the Y-direction and its second longest dimension is substantially parallel with the X-direction. Such an orientation may be considered as providing the fluid spray bar 56 in a "substantially horizontal" configuration.

Figure 15B:
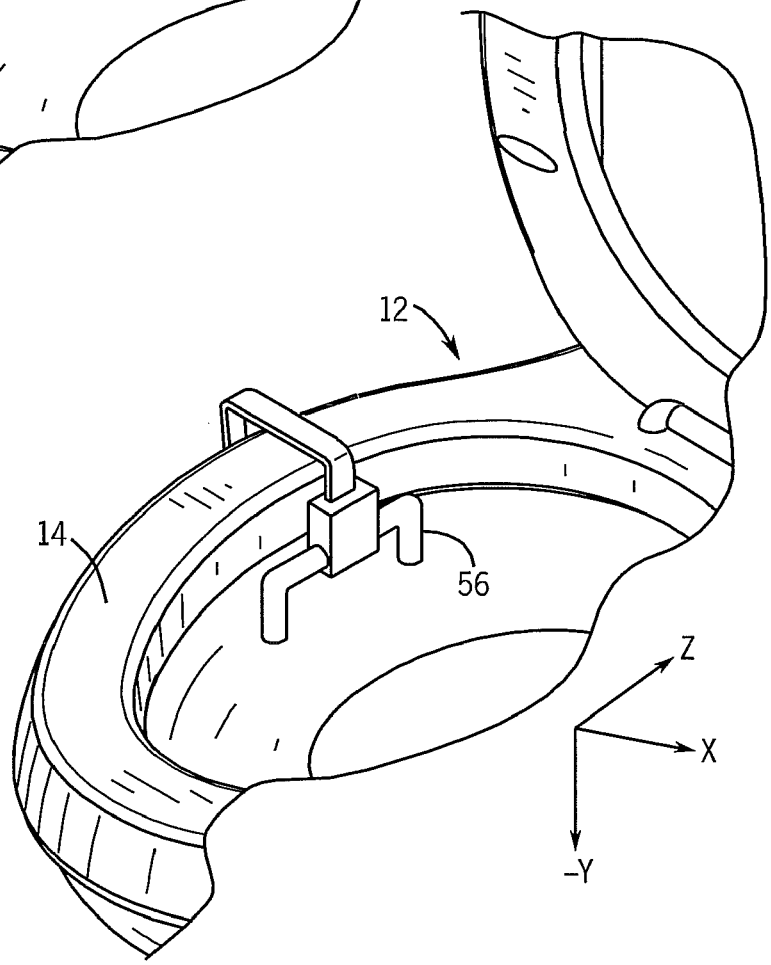
FIG. 15B is a perspective view of a fluid spray bar for a toilet bowl cleaning device in accordance with an exemplary embodiment of the invention.

FIG. 15B shows a fluid spray bar 56 wherein the fluid spray bar 56 is mounted with its relatively longest dimension is substantially parallel with the Y-direction and its second longest dimension is substantially parallel with the Z-direction Such an orientation may be considered as providing the fluid spray bar 56 in a "substantially vertical" configuration.

One of skill in the art will appreciate that a fluid spray bar 56 may be provided in either a horizontal or vertical position—or in any position that is suitable for the desired application. A fluid spray bar 56 may be provided in such a way to minimize the chances for interfering with a user. In one embodiment, a fluid spray bar is mounted with its shortest dimension protruding into the open area of the toilet bowl.

FIG. 10A describes a non-limiting exemplary embodiment of a fluid spray bar 56 according to the present invention. The fluid spray bar 56 is made of teflon and has an internal channel diameter (not shown) for the providing of fluid communication of about ⅛". The arms of the fluid spray bar 56 have an outer diameter (not shown) of about ¼". The fluid spray bar 56 comprises an elongated main body section 56*c* and has first and second projection arms 56*b* at right angles from the main body section 56*c*. The fluid spray bar projection arms 56*a* are circular in the X-Z plane. In the embodiment of FIG. 10A, the projection arms 56*b* are coplanar. The fluid spray bar 56 further comprises first and second slits 57 on the first and second projection arms, respectively. The slits 57 are provided such that the slit has a slit height $H_{slit}$ of about 1 mm. The slit is provided such that it occupies about 65% of the circumference of the projection $circ_p$. The height of the spray bar $H_{SB}$ is about 45 mm. The width of the spray bar $W_{SB}$ is about 100 mm. The embodiment described in FIG. 10A is hereinafter referred to as "Sample A."

FIG. 10B describes a non-limiting exemplary embodiment of a fluid spray bar 56 according to the present invention. The fluid spray bar 56 is made of Teflon®. One of skill in the art will appreciate that alternative materials may be used to construct the fluid spray bar 56 of the present invention. For example, polypropylene and/or Delrin® may be used. The fluid spray bar 56 and has an internal channel diameter (not shown) for the providing of fluid communication of about ⅛". The arms of the fluid spray bar 56 has an outer diameter (not shown) of about ¼". The fluid spray bar 56 comprises an elongated main body section 56*c* wherein holes 57*a* with diameter of about 1 mm have been provided. The holes are provided in a staggered configuration wherein there is a height space $H_{space}$ between the holes 57*a* of about 3 mm and a width space $W_{space}$ between the holes 57*a* of about 2 mm. There are five holes total, with the middle hole being provided at approximately the midpoint of the fluid spray bar 56 in terms of positioning relative to $H_{SB}$ and $W_{SB}$. $H_{SB}$ of the embodiment shown in FIG. 10B is about 50 mm. $W_{SB}$ of the embodiment shown in FIG. 10B is about 6.35 mm. The embodiment described in FIG. 10B is hereinafter referred to as "Sample B."

Figure 10C:
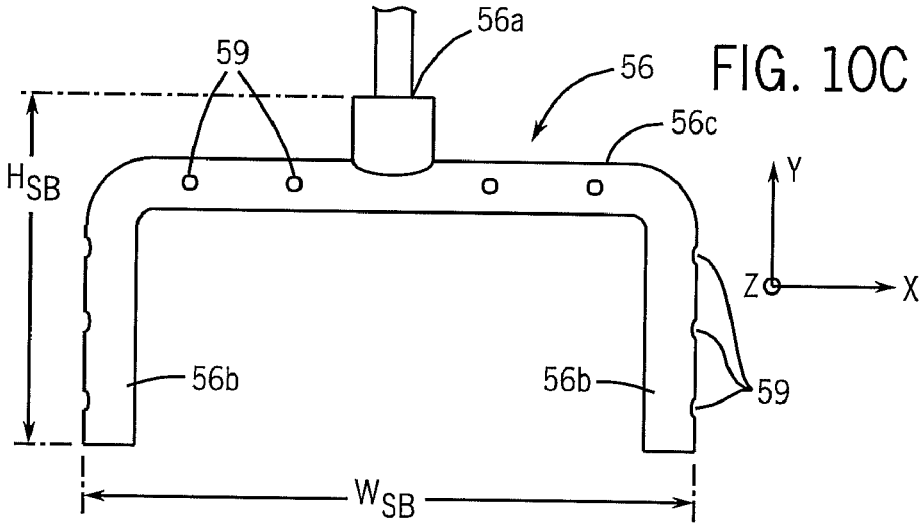
FIG. 10C is a perspective view of a fluid spray bar for a toilet bowl cleaning device in accordance with an exemplary embodiment of the invention.

FIG. 10C describes a non-limiting exemplary embodiment of a fluid spray bar 56 according to the present invention. The fluid spray bar 56 is made of teflon and has an internal channel diameter (not shown) for the providing of fluid communication of about ⅛". The arms of the fluid spray bar 56 has an outer diameter (not shown) of about ¼". The fluid spray bar 56 comprises an elongated main body section 56*c* and has first and second projection arms 56*b* at right angles from the main body section 56*c*. The fluid spray bar projection arms 56*a* are circular in the X-Z plane. In the embodiment of FIG. 10C, the projection arms 56*b* are coplanar. The fluid spray bar 56 further comprises a series of holes 57*a* on the main body section 56*c* and on the projection arms 56*b*. There are 3 evenly-spaced holes 57*a*, 5-10 mm apart, on each projection arm. And four evenly-spaced holes 57 along the main body section 56*c*. In the exemplary embodiment, the holes are about 15 mm apart. The holes have a diameter of about 0.60 mm. The height of the spray bar $H_{SB}$ is about 45 mm. The width of the spray bar $W_{SB}$ is about 110 mm. The embodiment described in FIG. 10C is hereinafter referred to as "Sample C."

Figure 10D:
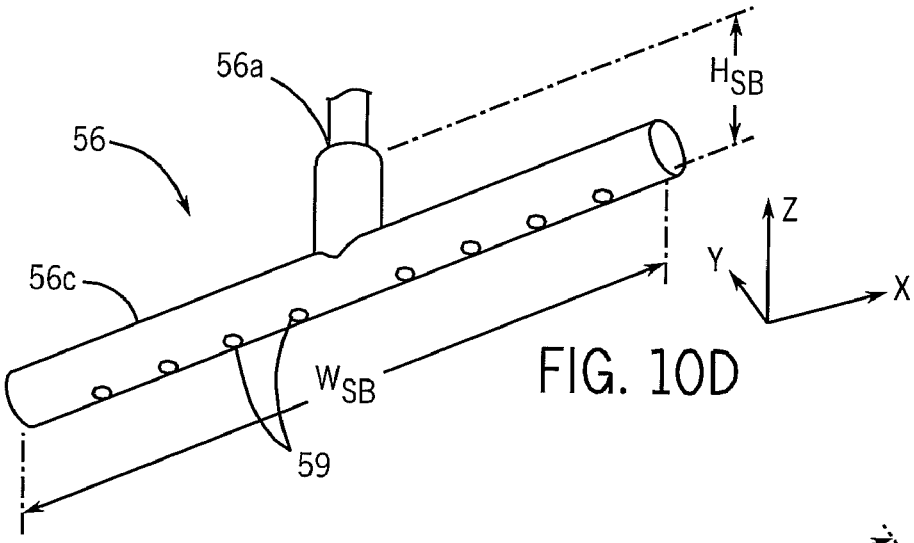
FIG. 10D is a perspective view of a fluid spray bar for a toilet bowl cleaning device in accordance with an exemplary embodiment of the invention.

FIG. 10D describes a non-limiting exemplary embodiment of a fluid spray bar 56 according to the present invention. The fluid spray bar 56 is made of teflon and has an internal channel diameter (not shown) for the providing of fluid communication of about ⅛". The arms of the fluid spray bar 56 has an outer diameter (not shown) of about ¼". The fluid spray bar 56 comprises an elongated main body section 56*c* having eight evenly spaced holes 57*a*, about 8 mm apart, along the main body. The holes have a diameter of about 1 mm. The height of the spray bar $H_{SB}$ is about 45 mm. The width of the spray bar $W_{SB}$ is about 110 mm. The embodiment described in FIG. 10C is hereinafter referred to as "Sample D."

Figure 10E:
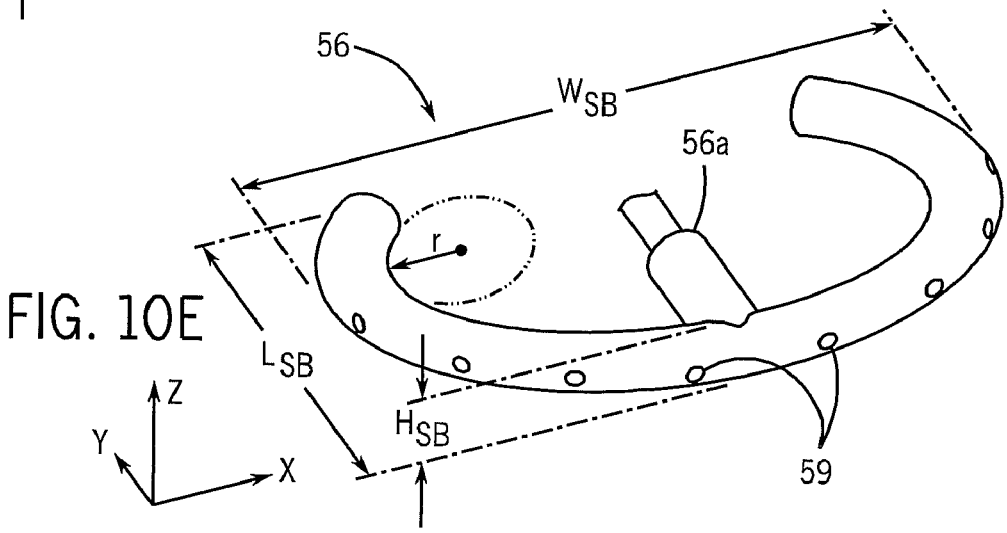
FIG. 10E is a perspective view of a fluid spray bar for a toilet bowl cleaning device in accordance with an exemplary embodiment of the invention.

FIG. 10E describes a non-limiting exemplary embodiment of a fluid spray bar 56 according to the present invention. The fluid spray bar 56 is made of teflon and has an internal channel diameter (not shown) for the providing of fluid communication of about ⅛". The arms of the fluid spray bar 56 has an outer diameter (not shown) of about ¼". The fluid spray bar 56 comprises an elongated main body section 56*c* having ten evenly spaced holes 57*a*, about 11 mm apart, along the main body with a radius of curvature r of about 20 mm. The holes have a diameter of about 0.80 mm. The height of the spray bar $H_{SB}$ is about 25.4 mm. The width of the spray bar $W_{SB}$ is about 150 mm. The length of the spray bar $L_{SB}$ is about 50 mm. The embodiment described in FIG. 10E is hereinafter referred to as "Sample E."

In one embodiment, a fluid spray bar 56 has a width of from about 5 mm to about 200 mm. In another embodiment, a fluid spray bar 56 has a width of from about 15 mm to about 150 mm. In one embodiment, a fluid spray bar 56 has a height of from about 5 mm to about 200 mm. In another embodiment, a fluid spray bar 56 has a width of from about 15 mm to about 150 mm.

Exemplary Spray Nozzles: Use Results

As discussed above, the spray devices described herein are provided such that the devices deliver about 7.5 g of cleaning composition having a viscosity (dynamic viscosity) of about 1.002 (N s/m$^2$)×10$^{-3}$, a density of about 0.9982 g/cm$^3$, and using a piston pump that provides an output pressure of about 30 psi to about 40 psi (measured at the nozzle, or outlet point). The 7.5 g of cleaning composition may be delivered in about 1.3 seconds. The spray devices and cleaning compositions are tested at room temperature (about 20° C.). The different fluid spray devices are mounted using a clip (described herein) in the 5 and −5 quadrants (FIG. 8) of a Kohler Memoirs® toilet (Kohler Co., Kohler, Wis.). The results for the different fluid spray devices are tested below. The quadrant coverage is measured according to the Spray Coverage within the Toilet Bowl Method described herein and the User Interaction is measured according to the Non Contact Spray Method described in Table 1 herein:

TABLE 1

Performance Results of Spray Devices

| Device | Quadrants Covered | User Interaction | $W_{SB}$ | $H_{SB}$ | Maximum Tangential Spray Angle |
|---|---|---|---|---|---|
| Sample A | 16 | No | 100 mm | 45 mm | 36° |
| Sample B | 14 | No | 6.35 mm | 50 mm | 22° |
| Sample C | 16 | No | 110 mm | 45 mm | 36° |
| Sample D | 14 | No | 160 mm | 6.35 mm | 22° |
| Sample E | 16 | No | 150 mm | 50 mm | 36° |
| Rotary Sprayer | 32 | Yes | N/A | N/A | N/A |

In some embodiments, the fluid spray bar provides coverage to at least 14 quadrants. In another embodiment, the fluid spray bar provides coverage to at least 16 quadrants. In yet more embodiments, the fluid spray bar provides a tangential spray component. In still more embodiments, the fluid spray bar does not interaction according to the Non Contact Spray Method described herein.

Container and Pump Mechanisms

Figure 12:
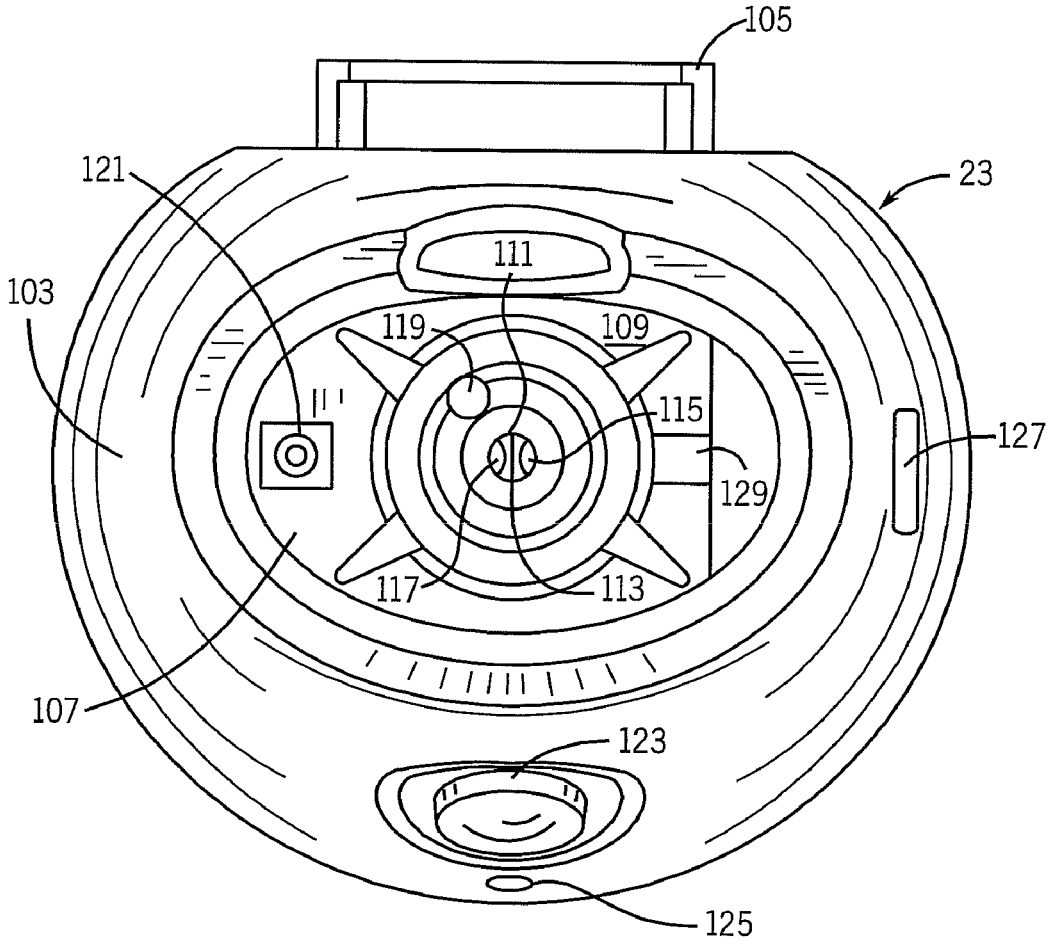
FIG. 12 is a top view of an exemplary means for moving fluid suitable for use in the toilet bowl cleaning device.

FIG. 12 shows an exemplary means for moving fluid 25 (FIG. 1) from the container 22 (FIG. 1) through the conduit 24 (FIG. 1) and to the spray nozzles 62 (FIG. 1) and spray holes 59 (FIG. 1) on the fluid spray bar 56 (FIG. 1) to be dispensed onto the inside surface 26 (FIG. 1) of the toilet bowl 12 (FIG. 1) can now be described. Looking at FIG. 12, the container holder 23 includes an exterior wall 103 having a rear mounting bracket 105 for supporting a hanger (not shown) that can be used to hang the container holder 23 and container 22 on the toilet tank. The container holder has a well 107 that supports the container 22 in an inverted position as shown in FIG. 1. The bottom wall 109 of the well 107 has an upwardly extending piercing post 111 that pierces a frangible seal on the container 22 and then enters a mouth of the container 22 when the container 22 is placed in the well 107 of the container holder 23. The piercing post 111 has a central piercing edge 113, an air vent inlet 115, and a fluid outlet 117.

The air vent inlet 115 is in fluid communication with a check valve (not shown). The check valve is normally closed so that fluid 25 does not leak out via the air vent inlet 115. The check valve opens by negative pressure that develops as fluid 25 is withdrawn from the container 22. The opened check valve aspirates air to the container 22 in a consistent manner, without introducing air in a manner that would cause foaming or gurgling. The check valve remains open until the pressure in the container 22 has equalized sufficiently to alleviate the negative pressure and then it closes.

The fluid outlet 117 provides a fluid path from the container 22 to a conduit and then to a pump inlet port 248 as described below. A valve 119 controls release of fluid 25 from the fluid outlet 117. The weight of the container 22 opens the valve 119 when the container is installed in the container holder 23. A power switch 121 in the bottom wall 109 of the well 107 moves downward when the weight of the container 22 is applied to the power switch 121 when the container 22 is installed in the container holder 23. The power switch 121 supplies power from batteries (not shown) to a controller and pumping apparatus as described below. The front vertical surface of the container holder 23 also includes a manual actuator button 123 and a light emitting diode (LED) 125 which are in electrical communication with the controller. The container holder 23 also includes a push button 127 that moves a locking tab 129 that engages the container closure to lock the container 22 in the container holder 23.

Figure 13:
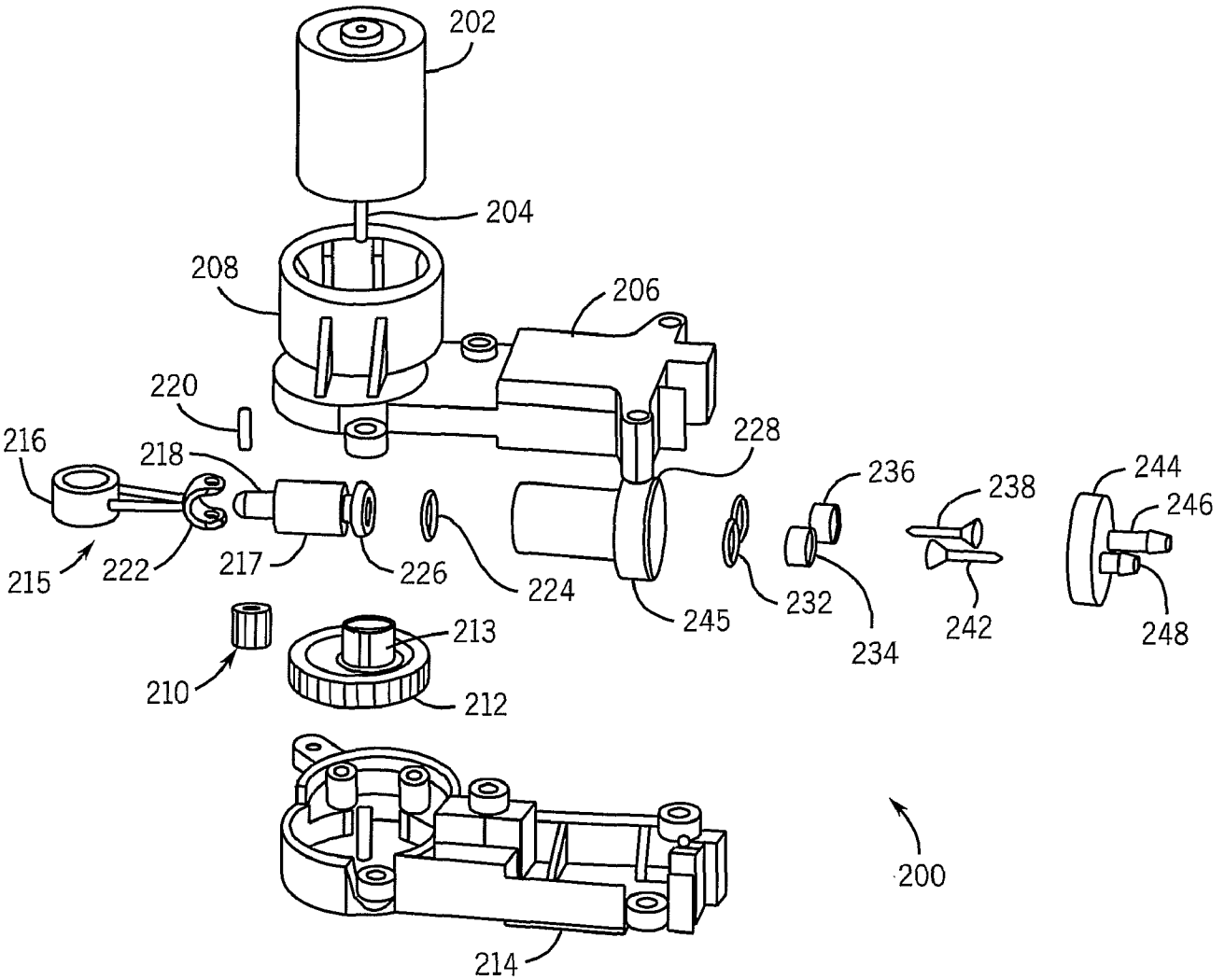
FIG. 13 is an exploded perspective view of an exemplary embodiment electrical pump suitable for use in the toilet bowl cleaning device.

Turning now to FIG. 13, an exploded perspective view of a pump 200 that is part of the pumping apparatus is shown. The pump 200 may be secured inside the container holder 23. The pump 200 includes an electric DC motor 202 that is in electrical communication with batteries (not shown) and the controller. The motor 202 includes a drive shaft 204. The motor 202 is housed in a top pump housing 206 in the top annular wall 208 of the top pump housing 206. The pump 200 includes a drive gear 210 that is connected at the lower end of the drive shaft 204. The drive gear 210 meshes with a second gear 212 in the pump drive train. The gear 212 has an eccentric circular disk 213 on its upper surface. The gears 210, 212 are housed in a bottom pump housing 214.

The pump 200 includes a piston crank 215 having a collar 216 at one end. The collar 216 receives the circular disk 213 of the gear 212 when the pump 200 is assembled. The pump 200 also includes a piston 217 having a connector 218 that is assembled with a connecting pin 220 to a yoke 222 at the forward end of the piston crank 215. An O-ring seal 224 is arranged in an outer groove 226 on a forward section of the piston 217. The piston 217 reciprocates in a cylindrical pump chamber 228 with the O-ring seal 224 engaging an inner surface of the pump chamber 228 to prevent fluid leakage. The pump chamber 228 includes a pair of O-ring valve seals 232 and valve holders 234, 236 that engage umbrella check valves 238, 242. A pump connector 244 closes a forward end 245 of the pump chamber 228. The pump connector 244 includes a pump outlet port 246 and a pump inlet port 248.

During operation of the pump 200, the controller supplies electrical current from the batteries to the motor 202 under certain conditions described below. When current is provided to the motor 202, the drive shaft 204 rotates the drive gear 210 which in turn rotates the second gear 212. The circular disk 213 of the gear 212 moves the piston crank 215 forward and rearward by way of the engagement of the eccentric disk 213 and the collar 216. On the rearward stroke of the piston crank 215 (which is movement toward the collar end of the piston crank 215), fluid is drawn into the pump chamber 228 by way of the pump inlet port 248 which is in fluid communication by way of a conduit (not shown) with the fluid outlet 117 of the piercing post 111. On the forward stroke of the piston crank 215 (which is movement toward the pump connector 244), fluid is expelled from the pump chamber 228 by way of the pump outlet port 246 which is in fluid communication with the conduit 24 which delivers the fluid to the fluid spray bar 56 to be dispensed onto the inside surface 26 of the toilet bowl 12 as described above.

Use of the Device

Having described the components of an example embodiment of a device 8 for spraying an inner surface of a toilet bowl with a chemical, a functional flow diagram of a software program routine for operating the device 8 can be explained with reference to FIG. 14. The functional flow diagram is used to generate a software program used to control the device 8. The controller of the device 8 includes a microprocessor under the control of the software program which is stored on memory of the controller. The software program can be stored in the controller memory using conventional techniques. The controller may be secured inside the container holder 23. The controller is in electrical communication with the power switch 121, the manual actuator button 123, the LED 125, the motor 202 of the pump 200, and a source of electricity (e.g., batteries secured inside the container holder 23). Suitable controllers are microcontrollers available from Elan Microelectronics Corp., Hsinchu City, Taiwan.

Figure 14:
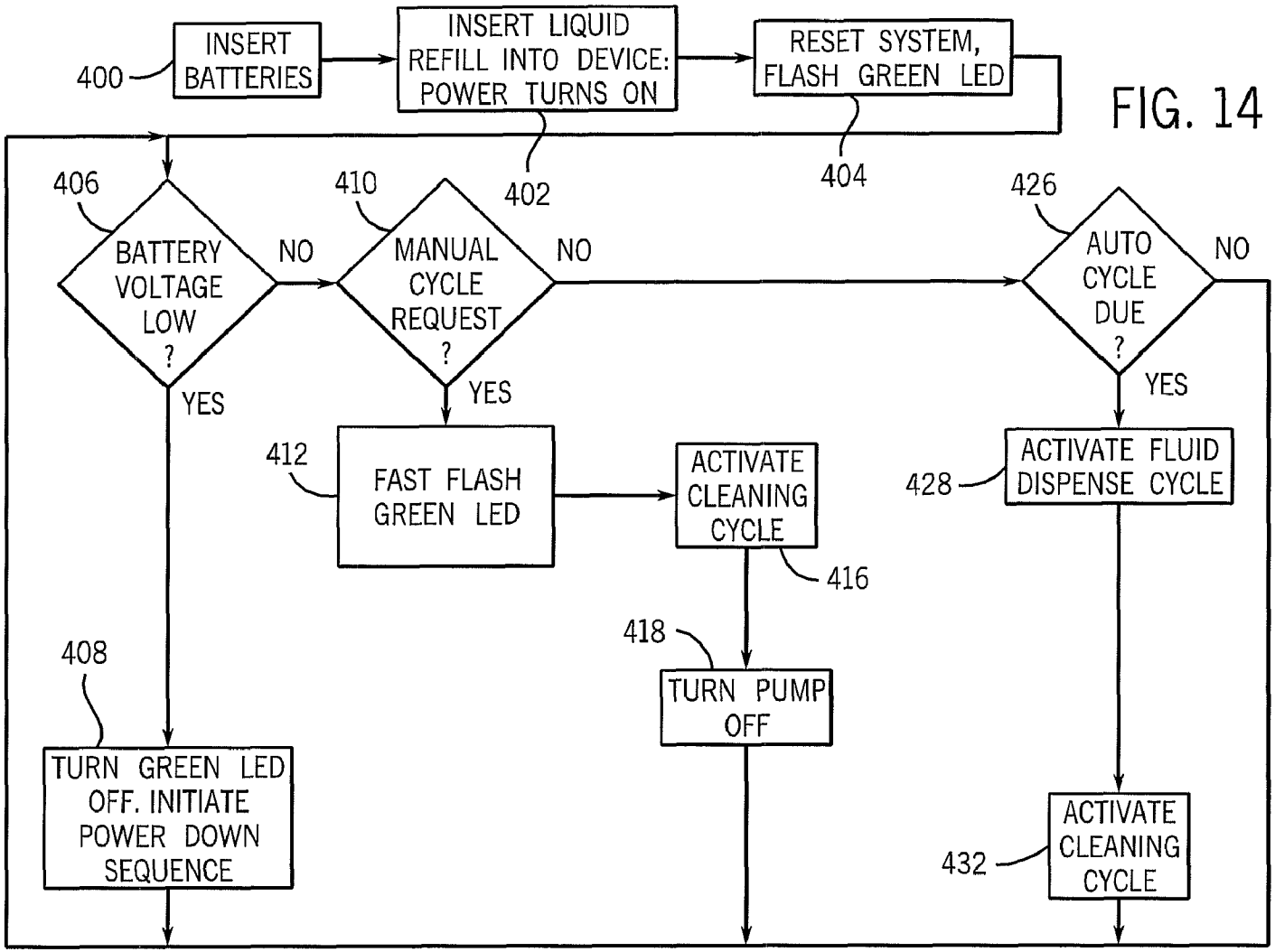
FIG. 14 is a functional flow diagram of the steps in an example operating method for the toilet bowl cleaning device of FIG. 1.

Referring to the functional flow diagram of FIG. 14, in a first step 400, a user inserts batteries into a battery compartment in the container holder 23. Battery compartments and their wiring to a controller are known in the art and therefore will not be explained further. In a second step 402, the container 22 (which may be a liquid refill) is installed in the container holder 23 causing the power switch 121 in the bottom wall 109 of the well 107 of the container holder 23 to move downward thereby completing a circuit to supply electrical power from batteries to the controller. This results in a reset of all controller system counters and fault conditions, and causes the LED 125 to flash to indicate to the user that the device 8 has properly powered up and a timer has been started for the first automatic discharge as described below. The LED 125 then remains on. In one example embodiment, the timer may be started on an automatic discharge that will take place eight hours from the reset of all controller system counters and fault conditions.

The software routine then advances to step 406. The device 8 should function until the average battery voltage reaches a lower threshold voltage when the pump 200 is not running. In step 406, the controller checks the available battery voltage. If the battery voltage is below a predetermined value, a low voltage shutdown occurs at step 408 prior to controller microprocessor loss. In step 408, the LED 125 is turned off and a power down sequence occurs. If the battery voltage is at or above a predetermined value, the routine proceeds to step 410.

At step 410, the controller responds to any manual cycle request from the pressing of the manual actuator button 123. If the manual actuator button 123 has been pressed, the routine advances to step 412. The manual cycle will dispense cleaning solution five seconds after the depression and release of the manual actuator button 123. At step 412, the LED 125 will flash after the manual actuator button 123 has been pressed. The routine then proceeds to step 416 in which the controller provides electrical current to the motor 202 of the pump 200 to deliver fluid to the fluid spray bar 56 to be dispensed onto the inside surface 26 of the toilet bowl 12 as described above. The controller can provide electrical current to the motor 202 of the pump 200 for any selected time period depending on the amount of fluid that is desired to be dispensed onto the inside surface 26 of the toilet bowl 12. One non-limiting example of a pumping time period is one second after which the routine moves to step 418. After step 418, the routine proceeds back to step 406.

When step 406 indicates that the battery voltage is not low and step 410 indicates that a manual cycle request has not been initiated by pressing the manual actuator button 123, the routine proceeds to step 426. At step 426, the controller checks the time count of the automatic discharge timer that was started on the reset of all controller system counters and fault conditions. If the time count of the automatic discharge timer indicates that an automatic dispensing is not set to occur, the routine proceeds back to step 406. If the time count of the automatic discharge timer indicates that an automatic dispensing is to occur (e.g., the eight hour dispensing interval has been reached), the routine proceeds to step 428.

At step 428, the controller first provides electrical current to the motor 202 of the pump 200 to deliver fluid to the nozzle 20 to be dispensed onto the inside surface 26 of the toilet bowl 12 as described above. After a predetermined time period, the controller measures the voltage drop from the batteries. If the voltage drop is less than or equal to a predetermined value, the controller provides electrical current to the motor 202 of the pump 200 for a predetermined pumping time period (e.g., 1 second). However, if the voltage drop exceeds a predetermined value, the controller provides electrical current to the motor 202 of the pump 200 for a pumping time period (e.g., 1.2 seconds) greater than the predetermined pumping time period (e.g., 1 second). In addition, the magnitude of the measured voltage drop can be used to select the length of the extended pumping time. For example, greater voltage drops may lead to 1.4 or 1.6 seconds of pumping time. Suitable software subroutines can be used to select the extended pumping time. The extended pumping time at lower voltages is beneficial in that lower voltages result in lower pump motor speeds which reduce the fluid dispensed to the toilet bowl 12. By extending the pumping time at lower pump speeds, a consistent amount of fluid can be dispensed (e.g., 5 milliliters) even though the pump speed has decreased in relation to the pump speed at higher voltages.

At the end of the pumping time period, the routine proceeds to step 432 in which the timer may be restarted on a second automatic discharge that will take place 8 hours from the end of the pumping time period. The routine then proceeds back to step 406. Because the routine is looping, when step 432 is next reached in the routine, the timer will be restarted on a third automatic discharge that will take place 8 hours from the end of the second pumping time period. This process will repeat itself such that automatic dispensings will continue at these 8 hour intervals until the battery voltage becomes too low (see steps 406 & 408) or the fluid is depleted.

It should be appreciated that any number of alternative time periods can be used in the software routine. For example, the automatic dispensing intervals could be, without limitation, four hours, six hours, or ten hours. Software programming techniques can be used to readily adjust these and other variables.

Thus, the present invention provides a toilet bowl cleaning and/or deodorizing device that delivers a chemical into the toilet bowl. The device provides consumers with an automatic, unattended dispensing of the toilet bowl cleaning fluid. The device can keep the toilet bowl clean for up to thirty days without scrubbing, and gets a dirty toilet bowl cleaner in days. The device provides overall bowl cleanliness by enhanced shine, removal of hard water lines and retardation of biofilm, mold and mildew growth. The device has quiet, unattended operation, and manual dispensing is available in addition to automatic cycles.

Although the present invention is in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides an automatic and/or manual toilet bowl cleaning device where the inner surface of the toilet bowl can be cleaned around the entire circumference of the toilet bowl by application of a cleaning fluid without contacting the user while the user is using the toilet bowl.

What is claimed is:

1. A device for providing cleansing composition to the inner surface of a wall of an enclosure with a fluid, the device comprising:

a first fluid spray bar having an interior space for receiving fluid from a source of the fluid and for spraying the inner surface of the wall of the enclosure, wherein;

the first fluid spray bar comprises at least a first spray hole through which cleansing composition may be sprayed, the first spray hole being in fluid communication with the interior space of the spray bar, the first spray hole providing a first tangential spray; and wherein the first fluid spray bar does not spray in a direction across the enclosure toward an opposing wall of the enclosure when the first fluid spray bar is installed on the wall of the enclosure, and wherein the first fluid spray bar comprises a second spray hole through which cleansing composition may be sprayed, the second spray hole being in fluid communication with the interior space of the spray bar, the second spray hole providing a second tangential spray in a direction substantially opposite of the first tangential spray.

2. A device according to claim 1 wherein the first fluid spray bar comprises a third spray hole through which cleansing composition may be sprayed, the third spray nozzle being in fluid communication with the interior space of the spray bar, the third spray nozzle providing a spray in a substantially normal direction.

3. A device according to claim 2 wherein the device does not interact with a user during dispensing as measured according to a Non Contact Spray Method.

4. A device according to claim 2 wherein the device provides coverage to at least 14 quadrants according to a Spray Coverage with the Toilet Bowl Method.

5. A device according to claim 1 wherein the fluid spray bar has a width of from about 5 mm to about 200 mm.

6. A device according to claim 1 wherein the fluid spray bar has a height of from about 5 mm to about 200 mm.

7. A device according to claim 1 wherein the device further comprises:

a second fluid spray bar having an interior space for receiving fluid from a source of the fluid and for spraying the inner surface of the wall of the enclosure, wherein;

the second fluid spray bar comprises at least a first spray hole through which cleansing composition may be sprayed, the first spray hole of the second fluid spray bar being in fluid communication with the interior space of the second spray bar, the first spray hole of the second fluid spray bar providing a first tangential spray.

8. A device according to claim 7 wherein the second fluid spray bar comprises a second spray hole through which cleansing composition may be sprayed, the second spray hole of the second fluid spray bar being in fluid communication with the interior space of the second spray bar, the second spray hole of the second fluid spray bar providing a second tangential spray in a direction substantially opposite of the first tangential spray.

9. A device according to claim 8 wherein the second fluid spray bar comprises a third spray hole through which cleansing composition may be sprayed, the third spray of the second fluid spray bar being in fluid communication with the interior space of the second spray bar, the third spray nozzle of the second fluid spray bar providing a spray in a substantially normal direction.

10. A device according to claim 9 wherein the device does not interact with a user during dispensing as measured according to a Non Contact Spray Method.

11. A device according to claim 9 wherein the device provides coverage to at least 28 quadrants as measured according to a Spray Coverage with the Toilet Bowl Method.

12. A device for providing cleansing composition to the inner surface of a wall of an enclosure with a fluid, the device comprising:

a first fluid spray bar having an interior space for receiving fluid from a source of the fluid and for spraying the inner surface of the wall of the enclosure, wherein;

the first fluid spray bar comprises at least a first spray hole through which cleansing composition may be sprayed, the first spray hole being in fluid communication with the interior space of the spray bar, the first spray hole providing a first tangential spray, the first tangential spray having an angle of from about 0° to about 36°;

wherein the first fluid spray bar does not spray in a direction across the enclosure toward an opposing wall of the enclosure when the first fluid spray bar is installed on the wall of the enclosure, and wherein the first fluid spray bar comprises a third spray hole through which cleansing composition may be sprayed, the third spray nozzle being in fluid communication with the interior space of the spray bar, the third spray nozzle providing a spray in a substantially normal direction.

* * * * *